US011406165B2

(12) United States Patent
Sho

(10) Patent No.: US 11,406,165 B2
(45) Date of Patent: Aug. 9, 2022

(54) SLIDE FASTENER-ATTACHED PRODUCT

(71) Applicant: YKK Corporation, Tokyo (JP)

(72) Inventor: Yoshiyuki Sho, Toyama (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 16/480,430

(22) PCT Filed: Feb. 2, 2017

(86) PCT No.: PCT/JP2017/003840
§ 371 (c)(1),
(2) Date: Jul. 24, 2019

(87) PCT Pub. No.: WO2018/142548
PCT Pub. Date: Aug. 9, 2018

(65) Prior Publication Data
US 2020/0085151 A1 Mar. 19, 2020

(51) Int. Cl.

| | |
|---|---|
| ***A44B 19/26*** | (2006.01) |
| ***A44B 19/40*** | (2006.01) |
| ***A44B 19/38*** | (2006.01) |
| ***A44B 19/28*** | (2006.01) |
| ***A44B 19/08*** | (2006.01) |

(52) U.S. Cl.
CPC ..... *A44B 19/403* (2013.01); *A44B 19/08* (2013.01); *A44B 19/26* (2013.01); *A44B 19/28* (2013.01); *A44B 19/38* (2013.01)

(58) Field of Classification Search
CPC ..... A44B 19/403; A44B 19/26; A44B 19/08; A44B 19/28; A44B 19/38; A44B 19/60; A44B 19/42; A44B 19/24
See application file for complete search history.

(56) References Cited

U.S. PATENT DOCUMENTS

| | | | |
|---|---|---|---|
| 1,813,434 | A | 7/1931 | Bennett |
| 2,067,734 | A | 1/1937 | Silberman |

(Continued)

FOREIGN PATENT DOCUMENTS

| | | | |
|---|---|---|---|
| CN | 2688116 | Y | 3/2005 |
| CN | 1275555 | C | 9/2006 |

(Continued)

OTHER PUBLICATIONS

Office Action, Chinese Patent Application No. 201711285372.3, dated Apr. 3, 2020.

(Continued)

*Primary Examiner* — Robert Sandy
*Assistant Examiner* — Rowland Do
(74) *Attorney, Agent, or Firm* — Kilpatrick Townsend & Stockton LLP

(57) ABSTRACT

Provided is a slide fastener-attached product in which an element member, is fixed to an element attaching edge portion of a fastener attached member with a sewn portion for fixing. The sewn portion for fixing pierces the element attaching edge portion, and a thread forming the sewn portion for fixing holds a connecting member. A position that the sewn portion for fixing pierces the element attaching edge portion is apart from an element to be inside of the element attaching edge portion. Thereby, weight reduction and improvement in flexibility of the slide fastener-attached product can be achieved.

19 Claims, 10 Drawing Sheets

(56) References Cited

U.S. PATENT DOCUMENTS

| | | | | |
|---|---|---|---|---|
| 2,858,592 | A | 11/1958 | Schwartz | |
| 3,132,398 | A | 5/1964 | Schwendt et al. | |
| 3,302,259 | A | 2/1967 | Waldes | |
| 3,503,102 | A | 3/1970 | Inazawa | |
| 3,696,473 | A | 10/1972 | Jones | |
| 3,750,260 | A * | 8/1973 | Jakob | B29D 5/06 29/408 |
| 3,849,841 | A | 11/1974 | Borzner | |
| 3,874,038 | A | 4/1975 | Takamatsu | |
| 3,955,247 | A | 5/1976 | Takamatsu | |
| 3,977,053 | A | 8/1976 | Takamatsu | |
| 4,033,014 | A | 7/1977 | Manning | |
| 4,134,184 | A | 1/1979 | Motta | |
| 4,175,104 | A | 11/1979 | Moertel | |
| 4,187,791 | A * | 2/1980 | Moertel | A44B 19/34 112/475.16 |
| 4,257,839 | A * | 3/1981 | Yoshida | A44B 19/14 156/555 |
| 4,291,440 | A | 9/1981 | Yoshida | |
| 4,297,770 | A * | 11/1981 | Wulz | A44B 19/14 24/408 |
| 4,418,449 | A | 12/1983 | Heimberger et al. | |
| 4,425,683 | A | 1/1984 | Hata | |
| 4,425,684 | A | 1/1984 | Akashi et al. | |
| 4,425,685 | A | 1/1984 | Ogihara | |
| 4,458,391 | A | 7/1984 | Scarpini | |
| 4,485,532 | A | 12/1984 | Yoshida et al. | |
| 4,490,890 | A | 1/1985 | Yoshida et al. | |
| 4,495,679 | A | 1/1985 | Scarpini | |
| 4,639,981 | A | 2/1987 | Yoshida et al. | |
| 4,922,584 | A | 5/1990 | Funakawa et al. | |
| 5,008,986 | A | 4/1991 | Laudet et al. | |
| 5,297,319 | A | 3/1994 | Akashi et al. | |
| 5,469,605 | A | 11/1995 | Horikawa | |
| 5,678,285 | A | 10/1997 | Germani | |
| 6,065,192 | A | 5/2000 | Wang | |
| 6,352,044 | B1 * | 3/2002 | Peng | D05B 55/10 112/222 |
| 8,572,816 | B2 | 11/2013 | Dono et al. | |
| 2002/0100148 | A1 | 8/2002 | Tominaga et al. | |
| 2004/0181919 | A1 | 9/2004 | Mizuhara et al. | |
| 2005/0034284 | A1 | 2/2005 | Yu | |
| 2005/0235466 | A1 * | 10/2005 | Segawa et al. | A44B 19/34 24/396 |
| 2005/0257350 | A1 * | 11/2005 | Takamatsu et al. | A44B 19/60 24/436 |
| 2011/0005042 | A1 | 1/2011 | Thomas et al. | |
| 2012/0110795 | A1 | 5/2012 | Daijogo | |
| 2012/0246888 | A1 | 10/2012 | Matsushima et al. | |
| 2013/0133161 | A1 | 5/2013 | Ren | |
| 2015/0033512 | A1 | 2/2015 | Kojima et al. | |
| 2016/0095405 | A1 | 4/2016 | Wang | |
| 2016/0206054 | A1 | 7/2016 | Ni | |
| 2017/0265605 | A1 | 9/2017 | Davis | |
| 2017/0280832 | A1 | 10/2017 | Kojima et al. | |
| 2019/0357638 | A1 * | 11/2019 | Sho | A44B 19/38 |

FOREIGN PATENT DOCUMENTS

| | | | |
|---|---|---|---|
| CN | 103153122 | A | 6/2013 |
| CN | 103269616 | A | 8/2013 |
| CN | 104334785 | A | 2/2015 |
| CN | 108236164 | A | 7/2018 |
| EP | 0107113 | A1 | 5/1984 |
| EP | 1459643 | A2 | 9/2004 |
| EP | 2764790 | A1 | 8/2014 |
| FR | 2247999 | A1 | 5/1975 |
| GB | 2083548 | A | 3/1982 |
| GB | 2319806 | A | 6/1998 |
| JP | 40-13870 | A | 5/1965 |
| JP | 52-141747 | A | 11/1977 |
| JP | 56-089204 | A | 7/1981 |
| JP | 62-299205 | A | 12/1987 |
| JP | 2004283300 | | 10/2004 |
| TW | 201609016 | A | 3/2016 |
| WO | 2010032331 | | 3/2010 |
| WO | 2011/077534 | A1 | 6/2011 |
| WO | 2012/090276 | A1 | 7/2012 |
| WO | 2014102941 | | 7/2014 |

OTHER PUBLICATIONS

Office Action, Chinese Patent Application No. 201810120807.7, dated Mar. 23, 2020.
Office Action, Chinese Patent Application No. 201810090675.8, dated Mar. 27, 2020.
Office Action, Japanese Patent Application No. 2018-565923, dated Mar. 10, 2020.
Office Action, Japanese Patent Application No. 2018-565922, dated Mar. 10, 2020.
Office Action, Japanese Patent Application No. 2018-565921, dated Mar. 10, 2020.
U.S. Appl. No. 16/480,508, Non-Final Office Action, dated Aug. 13, 2020, 7 pages.
PCT International Application No. PCT/JP2017/036533, International Search Report dated Dec. 12, 2017.
PCT International Application No. PCT/JP2017/036534, International Search Report dated Dec. 12, 2017.
PCT International Application No. PCT/JP2017/036535, International Search Report dated Dec. 12, 2017.
International Search Report, PCT Application No. PCT/JP2017/003840, dated Apr. 25, 2017.
U.S. Appl. No. 16/476,754, Notice of Allowance, dated Jan. 22, 2021, 7 pages.
U.S. Appl. No. 16/480,394, Non-Final Office Action, dated Jan. 6, 2021, 15 pages.
U.S. Appl. No. 16/480,508, Notice of Allowance, dated Dec. 2, 2020, 7 pages.
European Patent Application No. 17894888.1, Extended European Search Report, dated Dec. 1, 2020, 9 pages.
European Supplementary Search Report, European Patent Application No. 17894796.6, dated Oct. 6, 2020, 10 pages.
European Supplementary Search Report, European Patent Application No. 17894731.3, dated Oct. 8, 2020, 9 pages.
Office Action, Chinese Patent Application No. 201810120807.7, dated Sep. 30, 2020, 34 pages.
U.S. Appl. No. 16/476,754 , Non-Final Office Action, dated Oct. 14, 2020, 6 pages.
Office Action, Chinese Patent Application No. 201810120863.0, dated Apr. 17, 2021, 17 pages.
"Non-final Office Action, U.S. Appl. No. 16/480,508, dated Jun. 11, 2021".
Examination as to Substance, Vietnamese Patent Application No. 1-2019-04797, dated Jan. 27, 2022, 4 pages.
Office Action, Taiwanese Patent Application No. 106119596, dated Nov. 27, 2017, 17 pages.
Office Action, Chinese Patent Application No. 201810120807.7, dated Mar. 2, 2021, 43 pages.
U.S. Appl. No. 16/480,508, Notice of Allowance, dated Feb. 24, 2021, 7 pages.
Office Action, Chinese Patent Application No. 201810120863.0, dated Apr. 17, 2020, 17 pages.

* cited by examiner

SLIDE FASTENER-ATTACHED PRODUCT

TECHNICAL FIELD

The present invention relates to a slide fastener-attached product formed such that an element member in which a plurality of independent elements are attached to a string-shaped connecting member at regular intervals is attached directly to an element attaching portion provided on products such as clothes.

BACKGROUND ART

Generally, slide fasteners are often used as an opening and closing tool for products such as clothes, commodities and industrial materials and for products such as various seats in cars, trains and airplanes. Such a slide fastener used for various products as above generally has a right and left pair of fastener stringers in which element rows are formed at tape side edge parts (also referred to as element attaching portions) of a fastener tape, and a slider sliding along the right and left element rows.

Examples of general fastener stringers include a fastener stringer formed by molding a thermoplastic resin monofilament in a coil shape or a zigzag shape to form a continuous fastener element, and sewing the continuous fastener element on the tape side edge part of the fastener tape to form an element row. Another example is a fastener stringer in which element rows are formed by a plurality of independent elements being formed of regular intervals by directly injection-molding synthetic resin to the tape side edge part of the fastener tape, or die-casting metal.

In Japanese Utility Model publication No. 40-13870 B (Patent Document 1), a slide fastener 50 is disclosed. The slide fastener 50 is formed by sewing an element member 60 in which a plurality of elements 61 are connected with a support string 62 to an edge of a fastener tape 51 with overlock stitches (over-edge chain stitches), as shown in FIG. 12.

In this case, the element member 60 is manufactured by forming a plurality of independent elements 60 in a predetermined shape with respect to the support string 62 by injection-molding or die-casting so as to wrap the support string 62 between leg portions of the elements 61. Further, in Patent Document 1, the support string 62 of the element member 60 is fixed with a sewing thread 52 forming the overlock stitches by sewing the element member 60 to the fastener tape 51 with the overlock stitches. Therefore, the element member 60 can be stably attached to the edge of the fastener tape 51.

Meanwhile, since the overlock stitches are used to attach the element member 60 as above, a layout (appearance) of the sewing thread 52 shown on a tape top surface and the one on a tape back surface of the fastener tape are naturally different from each other. Therefore, on the tape top surface side of the fastener tape 51, sewing thread (needle thread) 52 forming the overlock stitches is arranged not to overlap each element 61, as shown in FIG. 12. However, the sewing thread (looper thread) disposed on the tape back surface side of the fastener tape 51 tends to overlap the elements 61 due to a movement of a looper of the overlock sewing machine.

In a case that the sewing thread 52 overlaps the element 61 as above, it is considered that the sewing thread 52 which fixes the element member 60 becomes easy to loosen, and a position of the element member 60 with respect to the fastener tape 51 becomes easy to be unstable. It can also be considered that when the sewing thread 52 overlaps the elements 61, coupling of right and left element 61 rows or sliding of a slider may be influenced. Therefore, when the element member 60 is attached to the fastener tape 51 using an overlock sewing machine as in Patent Document 1, high technology is required so that the sewing thread 52 does not overlap the elements 61 on the tape back surface side of the fastener tape 51.

In conventional slide fasteners and fastener stringers, continuous fastener element in a coil shape or injection-molded synthetic resin elements are attached to a tape side edge part of a fastener tape to form an element row at the tape side edge part. Therefore, when the slide fastener is attached to a fastener attached member such as clothes, generally a part (generally called as a tape body portion) except the tape side edge part in the fastener tape of the fastener stringer is overlapped on a fastener attaching portion of the fastener attached member, and the both are sewn with a sewing machine.

Meanwhile, Japanese Patent publication No. 62-299205 A (Patent Document 2) discloses that, when a cloth of a product to which the slide fastener is attached is woven or knitted, an element member in which continuous fastener element or a plurality of fastener elements are fixed to a core string is directly fixed by weaving or knitting the cloth in order to improve an appearance (outer appearance quality) such as color or to reduce weight in the slide fastener attached products. Thereby, the fastener elements can be attached to the cloth directly without a fastener tape.

In a case that the fastener elements are woven or knitted directly to the cloth of the product as in Patent Document 2, operation processes can be decreased in manufacturing the slide fastener-attached product, compared to a case of, for example, manufacturing a slide fastener-attached product by first manufacturing a slide fastener, and thereafter, sewing a fastener tape of the slide fastener to the cloth of the product. Therefore, effects such as speeding up the manufacturing line or reduction in cost can be expected.

Further, since the fastener elements can be fixed by weaving or knitting directly to the cloth of the product, the fastener tape which is an essential component of the slide fastener is not required. Therefore, reduction in weight or improvement of flexibility of the slide fastener-attached product can also be expected.

PRIOR ART DOCUMENT

Patent Documents

Patent Document 1: JP-U-40-13870-B
Patent Document 2: JP-62-299205-A

SUMMARY OF INVENTION

Problems to be Solved by the Invention

Recently, in products such as clothes, bags and shoes, additional values are added by improving properties or applying various functions depending on use of each product. For the clothes and bags which are daily used, for example, further reduction in weight and improvement of flexibility have been demanded.

However, in conventional slide fasteners including the slide fastener 50 cited in Patent Document 1 as mentioned above, a fastener tape, a fastener element and a slider are essential as components of the slide fastener. Therefore, reduction in weight of the slide fastener is limited in the slide fastener-attached product to which the slide fastener is attached. Further, since the fastener tape of the fastener stringer is attached to the fastener attaching portion of the product by sewing process with a sewing machine, flexibility of the product may lower.

Meanwhile, as in Patent Document 2, when a slide fastener-attached product is manufactured by fixing the fastener elements or the element member by weaving or knitting directly to the cloth of the product, the fastener tape is not necessary as mentioned above. Therefore, reduction in weight of the slide fastener-attached product can be realized more easily.

However, in order to fix the fastener elements by weaving or knitting directly to the cloth of the product, high technology and exclusive facility are needed. As a result, it leads to an increase in facility cost, and securing and developing skilled engineers are also needed.

Depending on use of the product, desired function is applied to the cloth by coating the cloth with synthetic resin, etc in some cases. However, when the fastener elements are fixed by weaving or knitting directly at the time of weaving or knitting the cloth of the product as in Patent Document 2, it may be difficult to stably apply the desired function to the cloth by coating the cloth with synthetic resin, etc.

The present invention has been made in view of the problems of the above conventional technique, and a specific object of the invention is to provide a slide fastener-attached product in which elements can be easily attached to a fastener attached member of a product, reduction in weight and improvement of flexibility can be expected compared to conventional general slide fastener-attached product, and further, to provide a slide fastener-attached product in which a sewing thread of a sewn portion in which a member provided with a plurality of elements is sewn to the product can less likely to loosen.

Means for Solving the Problems

In order to achieve the above object, the slide fastener-attached product provided by the present invention has, as a most principal structure, a pair of element members in which a plurality of independent elements are attached to a connecting member at regular intervals, a slider in which an element guide pass is formed between an upper blade and a lower blade, and a fastener attached member in which a pair of element attaching edge portions are provided at positions facing to each other. The element member is disposed on a position along the element attaching edge portion at an outside of the element attaching edge portion in a width direction of the element member and directly fixed to the element attaching edge portion with a sewn portion for fixing, the sewn portion for fixing pierces the element attaching edge portion and a thread forming the sewn portion for fixing holds the connecting member, and a position that the sewn portion for fixing pierces the element attaching edge portion is apart from the element of the element member to be inside of the element attaching edge portion in a width direction of the element member.

Particularly, in the slide fastener-attached product, it is preferable that the thread forming the sewn portion for fixing holds the connecting member so as to wrap it while contacting with an outer peripheral surface of the connecting member. It is also preferable that the sewn portion for fixing is formed to be bent in a zigzag shape with respect to a length direction of the element member with lock stitches.

The slide fastener-attached product provided by another Embodiment of the present invention has, as the most principal structure, a pair of element members in which a plurality of independent elements are attached to a connecting member at regular intervals, a slider in which an element guide pass is formed between an upper blade and a lower blade, and a fastener attached member in which a pair of element attaching edge portions are provided at positions facing to each other. The element member is disposed on a position along the element attaching edge portion at an outside of the element attaching edge portion in a width direction of the element member and directly fixed to the element attaching edge portion with a sewn portion for fixing with lock stitches, and the sewn portion for fixing is formed to be bent in a zigzag shape with respect to a length direction of the element member.

Particularly, in the slide fastener-attached product, it is preferable that the sewn portion for fixing pierces the element attaching edge portion, and an upper thread and a lower thread forming the sewn portion for fixing hold the connecting member. Further, it is preferable that a position that the sewn portion for fixing pierces the fastener attached member is apart from the element of the element member to be inside of the element attaching edge portion in the width direction of the element member.

In the slide fastener-attached product of the present invention as mentioned above, each element of the element member has a body portion fixed to the connecting member and a coupling portion extending from the body portion in the width direction of the element member and engaging with the element of a counterpart element member to be coupled, and a position that the sewn portion for fixing pierces the fastener attached member is disposed within a region corresponding to a forming area of the body portion of each element regarding the length direction of the element member.

In the slide fastener-attached product according to the present invention, it is preferable that each element of the element member has a body portion fixed to the connecting member and a coupling portion engaging with the element of a counterpart element member to be coupled, the coupling portion has a neck portion extending from the body portion in the width direction of the element member and a coupling head portion further extending from the neck portion in the width direction, and the element member is fixed so that a side surface part of the body portion which is disposed on an opposite side of the neck portion in the width direction is contacted with the element attaching edge portion.

In this case, it is preferable that an insertion concave portion to which a part of the element attaching edge portion is inserted is disposed on the side surface part of the body portion of the element along the length direction of the element member.

In the slide fastener-attached product according to the present invention, it is preferable that an auxiliary sewn portion which presses a thread forming the sewn portion for fixing toward the element attaching edge portion is formed overlapping the sewn portion for fixing. In this case, the auxiliary sewn portion is preferably formed with straight lock stitches.

Further, the thread forming the sewn portion for fixing is preferably fixed to the element attaching edge portion by bonding or welding, or by a film member for fixing the thread which is made of synthetic resin and attached to the element attaching edge portion.

In the slide fastener-attached product according to the present invention, it is preferable that the element attaching edge portion of the fastener attached member is formed such that a side edge part of the fastener attached member is folded in the width direction of the element member.

It is also possible that the element attaching edge portion of the fastener attached member is impregnated with a stiffener, or a reinforcement film member made of synthetic resin is attached to the element attaching edge portion of the fastener attached member.

Effects of the Invention

The slide fastener-attached product according to the present invention has a right and left pair of element members provided with a plurality of independent elements attached to a flexible connecting member at regular intervals, a slider in which an element guide pass to which the pair of element members is inserted is formed between an upper blade and a lower blade, and a fastener attached member provided with a pair of element attaching edge portions at positions facing to each other.

In the slide fastener-attached product according to the first Embodiment of the present invention, the element member is directly fixed along the element attaching edge portion at a position along the element attaching edge portion of the fastener attached member at an outside of the element attaching edge portion in the width direction of the element member with the sewn portion for fixing. The sewn portion for fixing is formed by piercing the element attaching edge portion of the fastener attached member. Further, a sewing thread forming the sewn portion for fixing holds the connecting member. Thereby, the element member is easily and stably fixed to the element attaching edge portion of the fastener attached member.

In this case, a position that the sewn portion for fixing pierces the fastener attached member is apart from the element of the element member to be inside of the element attaching edge portion in the width direction of the element member. In other words, a predetermined interval is formed between the position that the sewn portion for fixing pierces the fastener attached member and the element of the element member in the width direction of the element member.

Here, the piercing position of the sewn portion for fixing being apart from the element means that, for example, when a thread (sewing thread) forming the sewn portion for fixing is disposed from the piercing position (or when the case is expected) parallel to the length direction of the element member, the thread of the sewn portion for fixing disposed parallel to the length direction is at a position apart from the element in the width direction of the element member, and does not contact with the element (the same goes to the second embodiment as described later). That is, it is sufficient that the piercing position of the sewn portion for fixing is disposed so that a gap is provided between a part of the thread extending from the piercing position of the sewn portion for fixing along the length direction and the element so that the both do not contact each other.

Since the piercing position of the sewn portion for fixing is apart from the element to be inside as above, damages such as cutting at the element attaching edge portion of the fastener attached member by the sewn portion for fixing which fixes the element member can be less likely to occur. Therefore, fixing state of the element member with respect to the fastener attached member can be stably maintained, and functions of the slide fastener formed on the product can be stably exerted for a long period of time. Further, when the element member is sewn to the fastener attached member using a sewing machine, it can be prevented that a needle of the sewing machine is contacted with the element of the element member. Thus, the element member can be fixed to the fastener attached member stably without breaking the needle due to the contact.

It should be noted that in the present invention, the piercing position of the sewn portion for fixing is disposed to be apart from the element, and when considering making the sewing needle not contact with the element of the element member at the time of sewing the element member, for example, it is preferable that a distance (separation distance) between the piercing position of the sewn portion for fixing and the element of the element member in the element width direction is specifically set at 0.4 mm or more, more preferably 0.8 mm or more. A thickness of the sewing needle is changed arbitrarily depending on the thickness of the fastener attached member to which the element member is fixed in some cases. Therefore, it is preferable that the distance between the piercing position of the sewn portion for fixing and the element of the element member in the element width direction is larger than the thickness (thickness dimension) of the fastener attached member with respect to the fastener attached member. For stably fixing the element member to the fastener attached member with the sewn portion for fixing, the distance between the piercing position and the element in the element width direction is set at 30 mm or smaller, preferably 10 mm or smaller and more preferably 5 mm or smaller.

Further, in the slide fastener-attached product of the present invention as above, the slide fastener can be configured without a fastener tape which has been an essential component in the conventional slide fasteners. Since the fastener tape is not necessary as above, reduction in weight and improvement of flexibility of the slide fastener-attached product can be achieved. In the present invention, for a fastener attached member to which a desired function such as waterproofness is applied, for example, an element member is directly fixed afterward with a sewn portion for fixing formed with a zigzag stitch sewing machine. Therefore, it is also possible to manufacture a slide fastener-attached product in which the fastener attached member (cloth) has a special function easily and at a low cost.

In the slide fastener-attached product according to the first embodiment in the present invention as mentioned above, a thread forming a sewn portion for fixing contacts an outer peripheral surface of the connecting member and holds the connecting member so as to wrap it. Thereby, the connecting member can be fixed firmly with the thread forming the sewn portion for fixing, and the element member is easily and stably fixed to the element attaching edge portion of the fastener attached member with the sewn portion for fixing. In the present invention, it is also possible that the connecting member is held and fixed by piercing the connecting member with the thread of the sewn portion for fixing.

In the slide fastener-attached product according to the first embodiment, the sewn portion for fixing is formed to be bent in a zigzag shape with respect to the length direction of the element member with lock stitches. For such a slide fastener-attached product, it is possible to sew the element member to the element attaching edge portion of the element attached member easily and stably by using a zigzag stitch sewing machine, for example. Therefore, the slide fastener-attached product of the present invention can be manufactured stably and at a low cost without introducing an expensive and exclusive facility.

Further in the present invention, since it is possible to sew the element member to the element attached member using a zigzag stitch sewing machine, the thread is hardly broken at the sewn portion for fixing which fixes the element member. In addition, it can be avoided relatively easily that the thread (upper thread and lower thread) of the sewn portion for fixing formed by the zigzag stitch sewing machine overlaps the element on a top surface side and a back surface side of the fastener attached member. Thus, looseness of the thread due to overlapping the thread for the sewn portion for fixing which fixes the element member to the fastener attached member on the element can be prevented, and a state of fixing the element member to the element attached member can be stably maintained. Furthermore, worsened coupling of right and left element rows or lowered slidability of the slider due to the overlap of the thread of the sewn portion for fixing can also be prevented.

In the slide fastener-attached product according to the second embodiment in the present invention, the element member is directly fixed at a position abreast of the element attaching edge portion of the fastener attached member at an outside of the element attaching edge portion in the width direction of the element member along the element attaching edge portion with the sewn portion for fixing with lock stitches. The sewn portion for fixing is formed to be bent in a zigzag shape with respect to the length direction of the element member.

According to the slide fastener-attached product in the present invention, the element member can be sewn easily and stably to the element attaching edge portion of the fastener attached product by using a zigzag stitch sewing machine, for example. Therefore, the slide fastener-attached member of the present invention can be manufactured stably and at a low cost without introducing an expensive and exclusive facility.

Since it is possible to sew the element member to the fastener attached member using a zigzag stitch sewing machine as above in the present invention, thread breakage is less likely to occur at the sewn portion for fixing which fixes the element member. Further, the thread (upper thread and lower thread) of the sewn portion for fixing formed with the zigzag stitch sewing machine can be relatively easily avoided to overlap the element on a top surface side and a back surface side of the fastener attached member. Therefore, looseness of the thread due to the overlap of the thread of the sewn portion for fixing which fixes the element member to the fastener attached member on the element can be prevented, and a state that the element member is fixed to the fastener attached member can be stably maintained. Further, worsened coupling of the right and left element rows and a lowered slidability of the slider due to the overlap of the thread of the sewn portion for fixing on the element can also be prevented.

Further, in the slide fastener-attached product of the present invention, the slide fastener can be configured without a fastener tape. Thereby, reduction in weight and improvement of flexibility of the slide fastener-attached product can be achieved. In the present invention, for a fastener attached member to which a desired function such as waterproofness is applied, an element member is directly fixed afterward with a sewn portion for fixing formed with a sewing machine. Therefore, it is also possible to manufacture a slide fastener-attached product in which the fastener attached member (cloth) has a special function easily and at a low cost.

In the above-mentioned slide fastener-attached product according to the second embodiment of the present invention, the sewn portion for fixing is formed by piercing the element attaching edge portion of the fastener attached member, and the sewn portion for fixing holds the connecting member with the upper thread and the lower thread. Thereby, the element member is stably fixed to the element attaching edge portion of the fastener attached member with the sewn portion for fixing.

In this case, the upper thread and the lower thread of the sewn portion for fixing contact the outer peripheral surface of the connecting member and interlace with each other, thereby hold the connecting member so as to wrap it. Thereby, the connecting member can be fixed firmly with the upper thread and the lower thread of the sewn portion for fixing, and the element member can be easily and stably fixed to the element attaching edge portion of the fastener attached member with the sewn portion for fixing. In the present invention, it is also possible that the connecting member is held and fixed by piercing the connecting member with the upper thread and the lower thread of the sewn portion for fixing.

Further, in the second embodiment, a position that the sewn portion for fixing pierces the fastener attached member is apart from the element of the element member to be inside of the element attaching edge portion in the width direction of the element member. Thereby, damages such as cutting by the upper thread and the lower thread of the sewn portion for fixing can be less likely to occur at the element attaching edge portion of the fastener attached member. Therefore, a fixing state of the element member with respect to the fastener attached member can be stably maintained, and functions of the slide fastener formed on the product can be stably exerted for a long period of time. Further, when the element member is sewn to the fastener attached member using a sewing machine, the element member can be fixed to the fastener attached member stably without breakage of a sewing needle.

In the slide fastener-attached products according to the first and second embodiments as mentioned above, each element of the element member has a body portion fixed to the connecting member and a coupling portion extending from the body portion in the width direction of the element member and engaging with the element of a counterpart element member to be coupled, and a position that the sewn portion for fixing pierces the fastener attached member is disposed within a region corresponding to a forming area of the body portion of each element regarding the length direction of the element member. Since the piercing position of the sewn portion for fixing is set as above, the element member can be fixed to the fastener attached member firmly with the sewn portion for fixing. Further, it can be prevented that a position of each element in the length direction of the element member is displaced with respect to the fastener attached member.

In the slide fastener-attached products according to the first and the second embodiments, each element of the element member has a body portion fixed to the connecting member and a coupling portion engaging with the element of a counterpart element member to be coupled. The coupling portion has a neck portion extending from the body portion in the width direction of the element member and a coupling head portion further extending from the neck portion in the width direction, and the element member is fixed so that a side surface part of the body portion which is disposed on an opposite side of the neck portion in the width direction is contacted with the element attaching edge portion.

As each element of the element member has a structure as mentioned above, a plurality of independent elements can be formed in a predetermined shape stably by injection-molding, and the plurality of independent elements can be easily connected via the connecting member. Further, since the element member is fixed to the element attaching edge portion so that the side surface part of the body portion as mentioned above is contacted with the element attaching edge portion, the plurality of elements can be fixed firmly in a predetermined posture with respect to the fastener attached member.

In this case, the body portion of each element has an insertion concave portion to which a part of the element attaching edge portion is inserted at the above mentioned side surface part of the body portion. Each insertion concave portion is disposed along the length direction of the element member. Thereby, each element can be fixed more firmly to the element attaching edge portion of the fastener attached member, and a position and a posture of each element with respect to the fastener attached member can be more stable.

In the slide fastener-attached product according to the present invention, an auxiliary sewn portion which presses the thread (sewing thread) forming the sewn portion for fixing toward the element attaching edge portion of the fastener attached member is formed overlapping the sewn portion for fixing. Particularly in this case, the auxiliary sewn portion is formed with straight lock stitches.

Thereby, the sewing thread (upper thread and lower thread) of the sewn portion for fixing can be fastened by the auxiliary sewn portion, and the element member can be fixed to the element attaching edge portion of the fastener attached member more firmly, and looseness in the sewing thread of the sewn portion for fixing can be effectively prevented. In addition, when a slider is slid, the sewn portion for fixing and the element attaching edge portion of the fastener attached member can be less likely to contact with a flange portion of the slider, and can be protected from the flange portion of the slider by the auxiliary sewn portion. Therefore, even when the slider is in sliding operation repeatedly, damages such as a fray due to abrasion can be less likely to occur at the sewn portion for fixing and the element attaching edge portion of the fastener attached member.

Further in the present invention, the thread forming the sewn portion for fixing may be fixed to the element attaching edge portion by bonding or welding, or the thread forming the sewn portion for fixing may be fixed to the element attaching edge portion using a synthetic resin film member for fixing the thread which is attached to the element attaching edge portion. Thereby, looseness in the sewing thread of the sewn portion for fixing can be prevented, the element member can be fixed to the element attaching edge portion of the fastener attached member firmly, and the fixing state of the element member can be maintained stably.

Further, in the slide fastener-attached product according to the present invention, the element attaching edge portion of the fastener attached member is formed such that a side edge part of the fastener attached member is folded in the width direction of the element member. Therefore, the strength of the element attaching edge portion of the fastener attached member can be easily enhanced. Further, the element member can be fixed to the element attaching edge portion of the fastener attached member more firmly, and the position and the posture of each element with respect to the fastener attached member can be more stable.

Furthermore, as the side edge part of the fastener attached member is folded in the width direction of the element member, even when a side end edge of the fastener attached member (cloth) is frayed, for example, the fray is hidden on the back surface side of the element attaching edge portion and is not shown on the outside. Thereby, outer appearance quality (appearance) can be enhanced. Further, it can be prevented that the coupling of the right and left element rows are worsened and the slidability of the slider is worsened due to the fray of the side end edge.

In the present invention, the element attaching edge portion of the fastener attached member is impregnated with a stiffener, or a synthetic resin film member for reinforcement may be attached to the element attaching edge portion to wrap it. Thereby, even when the side edge part of the fastener attached member is not folded as above, the element attaching edge portion of the fastener attached member is easily reinforced, and the strength of the element attaching edge portion can be effectively enhanced. As a result, damages or frays can be less likely to occur at the element attaching edge portion, thereby the strength and durability of the slide fastener-attached product can be effectively enhanced. Further, since the element attaching edge portion can be reinforced without folding the side edge part of the fastener attached member as above, the element attaching edge portion having a smaller thickness dimension can be formed.

MODES FOR CARRYING OUT THE INVENTION

Hereinafter, modes for carrying out the invention will be described in detail showing embodiments with reference to the drawings. It should be noted that the present invention is not limited to the embodiments explained as below, and various changes can be made as long as having a substantially same structure as and similar functional effects to the present invention.

For example, a case that the slide fastener-attached product is a slide fastener-attached clothing item will be specifically explained in each embodiment as below. However, the slide fastener-attached products according to the present invention are not particularly limited to the clothes (clothing items), and various products including daily products such as shoes and bags, industrial materials, seats for automobile, trains and airplanes and others are included.

Embodiment 1

Figure 1:
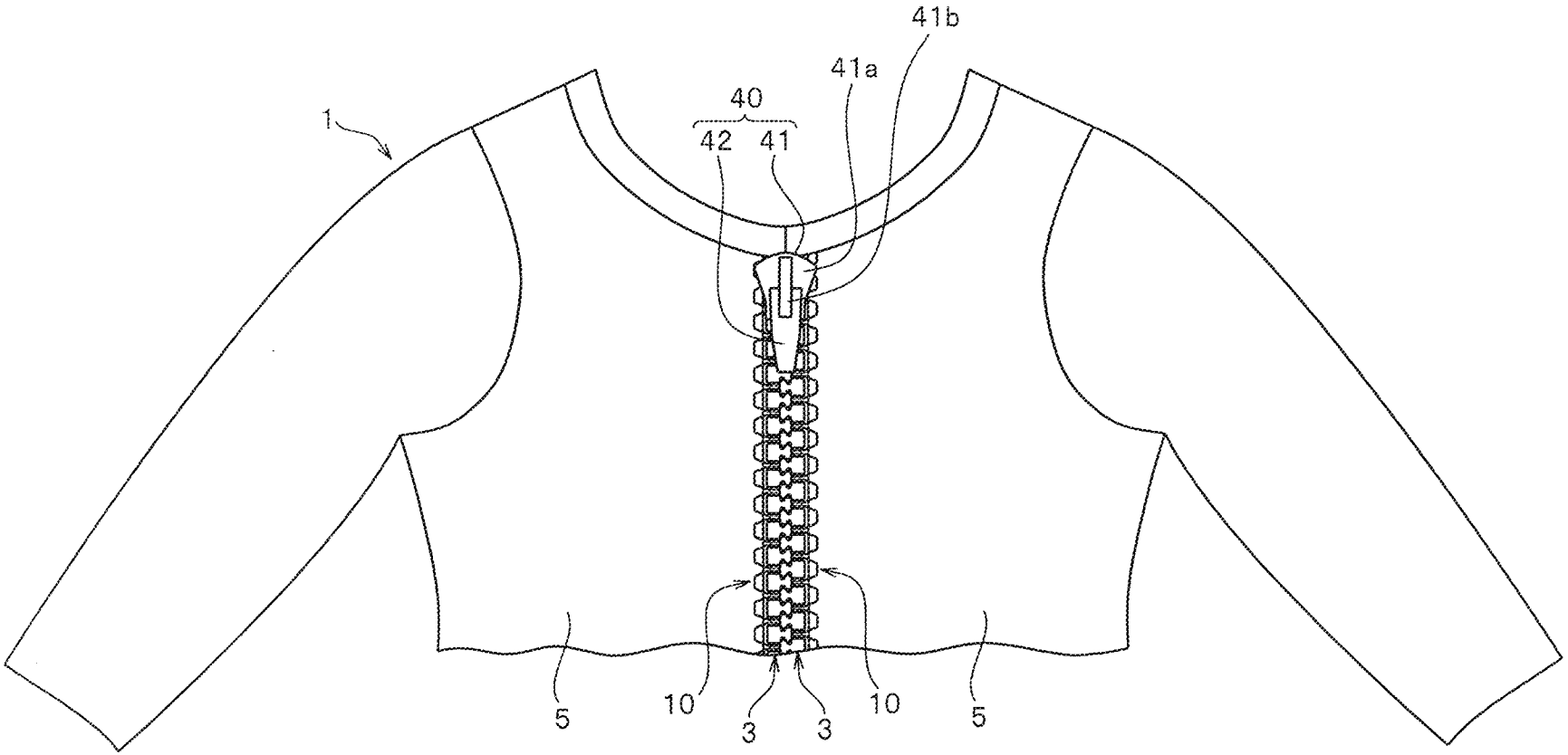
FIG. 1 is a schematic view illustrating schematically a slide fastener-attached product (clothes) according to Embodiment 1 of the present invention.
Figure 2:
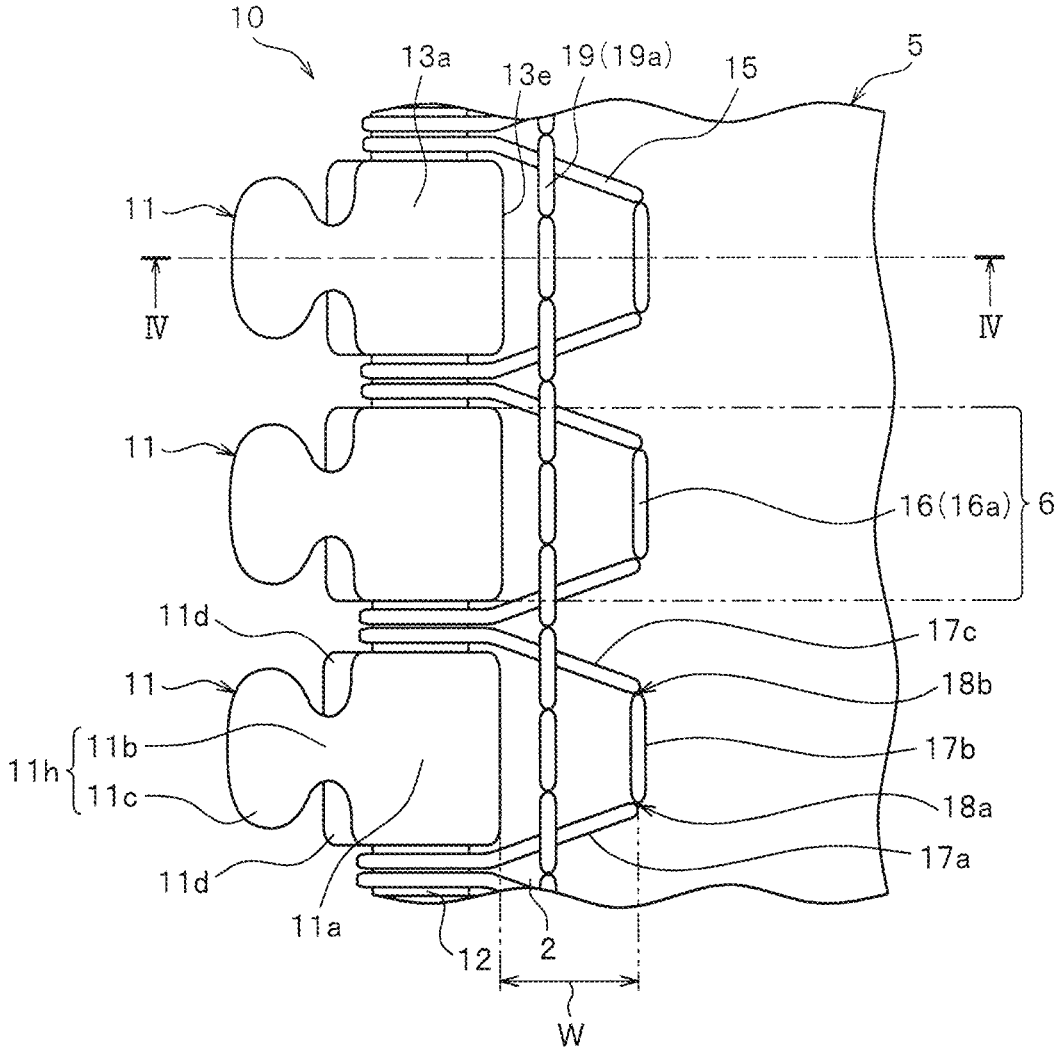
FIG. 2 is an enlarged plan view illustrating a part to which an element member of Embodiment 1 is attached to a fastener attaching portion of the product enlarged.
Figure 3:
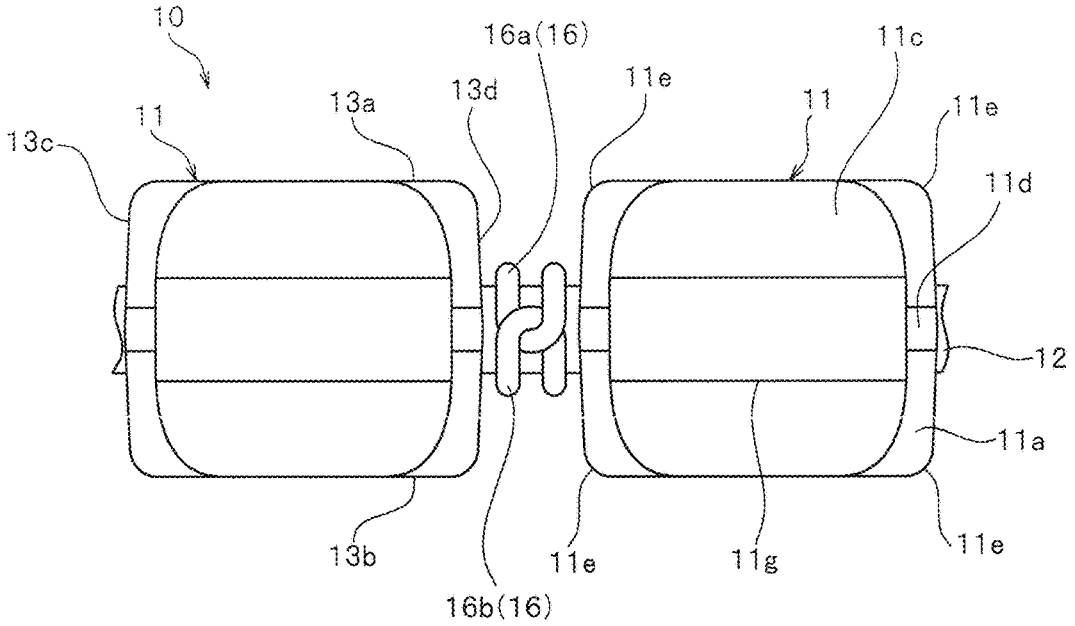
FIG. 3 is a side view illustrating the part to which the element member is attached to the fastener attaching portion seen from a counterpart element member to be coupled.
Figure 4:
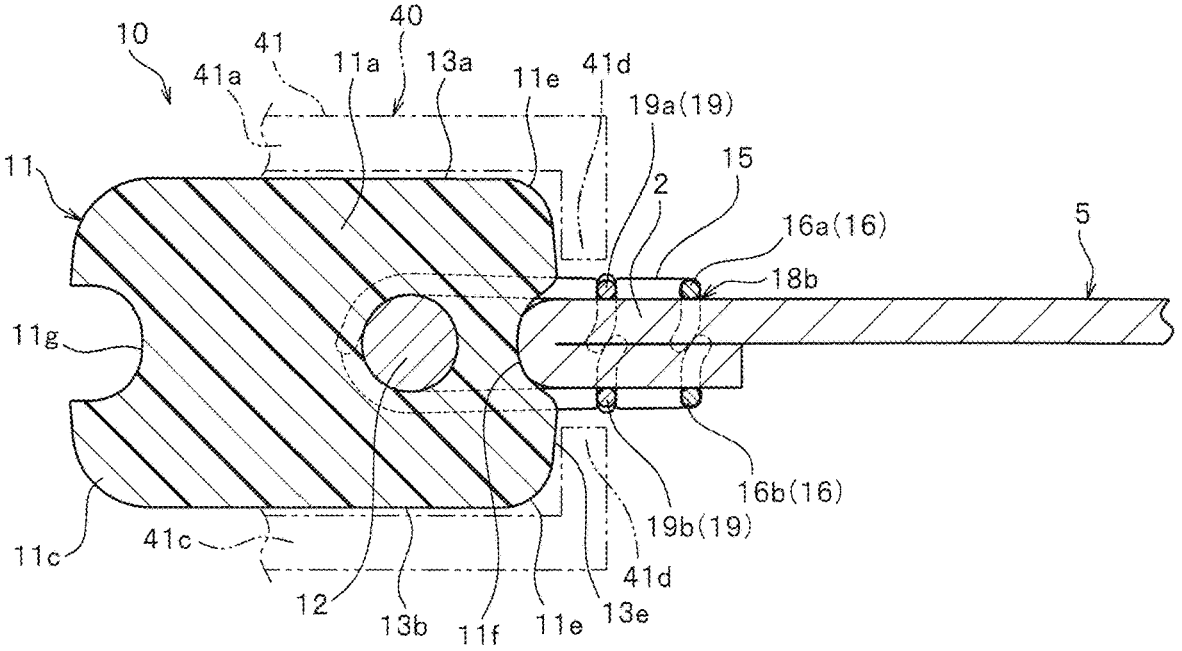
FIG. 4 is a cross-sectional view along the IV-IV line shown in FIG. 2.

FIG. 1 is a schematic view schematically illustrating a slide fastener-attached clothing item according to Embodiment 1. FIG. 2 is an enlarged plan view illustrating a part to which an element member is attached to a fastener attaching portion of clothes enlarged, and FIG. 3 is a side view illustrating the part seen from a counterpart element member to be coupled along the width direction of the element member. FIG. 4 is a cross-sectional view along the IV-IV line as shown in FIG. 2.

In the following descriptions regarding the element member, a front and rear direction is defined as a length direction of the element member parallel to a sliding direction of the slider, and particularly, a direction in which the slider slides to couple right and left element rows is defined as the front direction, and a direction in which the slider slides to separate the right and left element rows is defined as the rear direction.

A right and left direction is defined as a width direction of the element member (or a width direction of a cloth to be a fastener attached member), which is perpendicular to the sliding direction of the slider, and parallel to a top surface and a back surface of the cloth, for example. An upper and lower direction is defined as a direction perpendicular to the front and rear direction and the right and left direction, and a thickness direction of the element member perpendicular to the top surface and the back surface of the cloth, for example. Particularly in the following case, a direction in which a tab of the slider is disposed means an upper direction, and an opposite direction thereto means a lower direction.

The slide fastener-attached product according to Embodiment 1 is a slide fastener-attached clothing item (clothing item) 1, and right and left element attaching edge portions 2 are provided at front placket portions in a front body of the clothing item 1. Respective element members 10 are sewn to the element attaching edge portion 2 in the clothing item 1, and the right and left element rows 3 are formed thereon. Further, in the right and left element rows 3, a slider 40 is slidably attached along the element rows 3.

In this case, the cloth 5 configuring the front placket portion of the clothing item 1 (also referred to as a garment cloth) becomes a fastener attached member to which the element member 10 is attached. Accordingly, the slide fastener configured in Embodiment 1 has a right and left pair of fastener stringers provided with element rows 3 formed by directly fixing the element member 10 to the cloth 5 of the clothing item 1, and a slider 40 which can couple and separate the element rows 3 of the right and left fastener stringers.

The cloth 5 which becomes the fastener attached member is a cloth 5 forming the front placket portion of the clothing item 1, and has functions and properties (softness, thickness, texture, color and others) necessary to the clothing item 1. In Embodiment 1, the cloth 5 to which the element member 10 is sewn is cut in a predetermined shape and dimension depending on a shape and a design of the clothing item 1. Here, although a thickness of a general conventional fastener tape is 1.1 mm to 1.5 mm, the cloth 5 which is the fastener attached member used in Embodiment 1 and a cloth of other parts are formed to be thin in view of weight reduction, and has a thickness of 0.2 mm to 1.0 mm, for example, and preferably 0.4 mm to 0.7 mm.

In Embodiment 1, the right and left element attaching edge portions 2 provided on the cloth (fastener attached member) 5 are disposed at positions facing to each other in the front body of the clothing item 1 (i.e. facing edge portions of the front body), and are formed straight and continuously at facing edge portions of the front body. Here, the element attaching edge portion 2 provided on the cloth 5 is a part (area) having a predetermined dimension from facing side ends which face to each other of the cloth 5 which forms the right and left front placket portions toward an inside of the cloth 5 in the width direction of the element member 10. Therefore, the element attaching edge portion 2 of the cloth 5 is formed to have a constant width dimension along a length direction of the element member 10. The element attaching edge portion 2 is a part that a sewing thread 16 of a sewn portion for fixing 15 pierces, as described later, and a part contacting a body portion 11*a* (particularly side surface part 13*e*) of an element 11, as described later.

Figure 5:
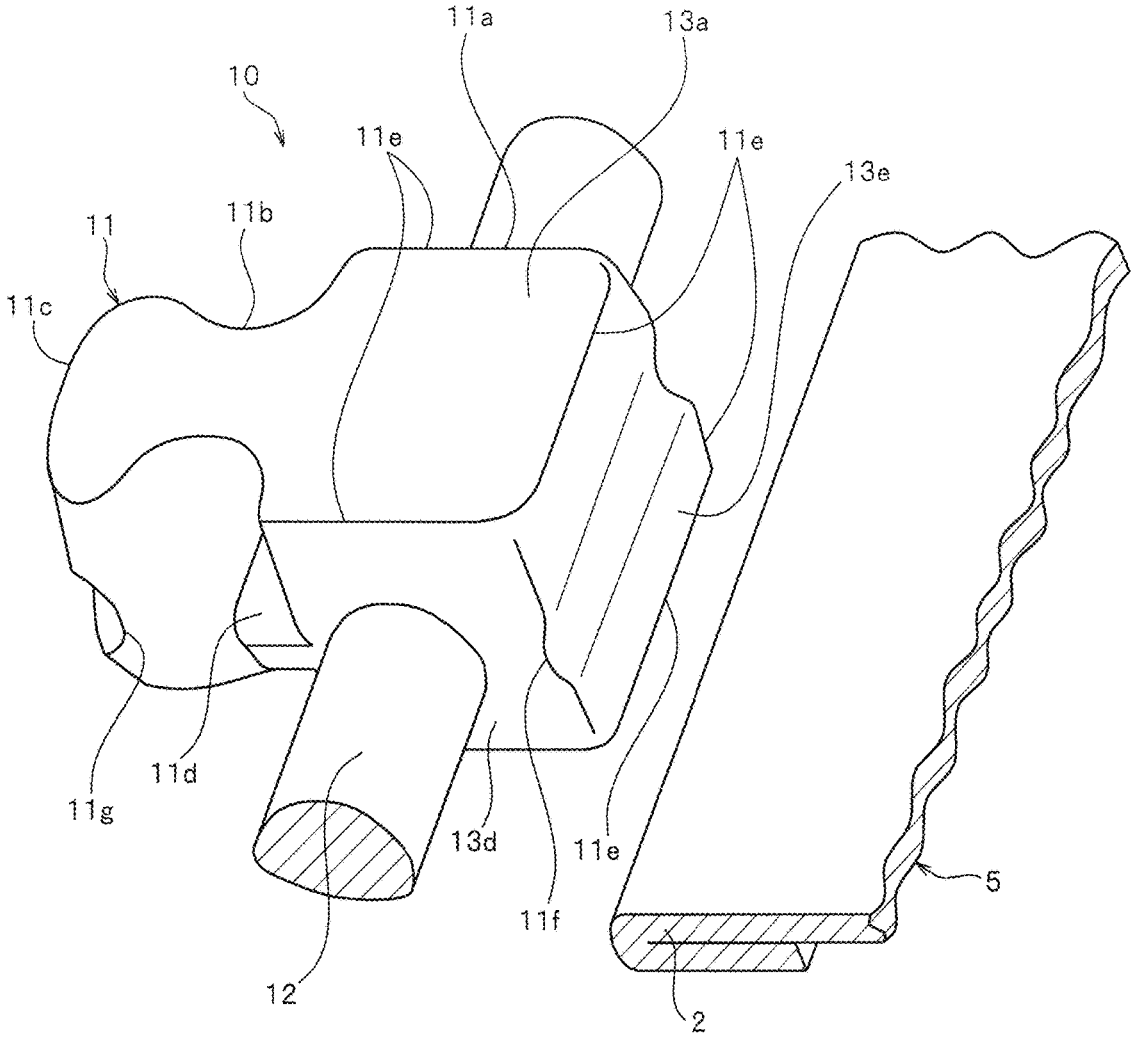
FIG. 5 is a perspective view illustrating a state of the element member before being attached to the fastener attaching portion of the product.

In this case, the right and left element attaching edge portions 2 are formed by folding a side edge part which is to be a cut end part of the cloth 5 in a U-shape in the width direction of the element member 10, as shown in FIGS. 4 and 5. Since the element attaching edge portion 2 is formed as above, the element attaching edge portion 2 is formed to be thicker locally than other parts among the thin cloth 5, and strength of the element attaching edge portion 2 can be enhanced.

Thereby, even when the sewing thread 16 (upper thread 16*a* and lower thread 16*b* described later) of the sewn portion for fixing 15 pierces the element attaching edge portion 2, as described later, the element attaching edge portion 2 is less likely to be cut by the sewing thread 16, and durability of the element attaching edge portion 2 can be enhanced. Further, since the strength of the element attaching edge portion 2 is enhanced, the element member 10 can be firmly fixed to the element attaching edge portion 2, and a position and a posture of each element 11 fixed to the element attaching edge portion 2 can be stabilized.

Furthermore, as the side edge part of the cloth 5 is folded in a U-shape, even when a side end edge of the cloth 5 is frayed, the fray is hidden on the back surface side of the element attaching edge portion 2 and is not shown on the outside. Thereby, the slide fastener-attached clothing item 1 has good outer appearance quality (outer appearance). Further, it can be prevented that the coupling of the right and left element rows 3 are worsened and the slidability (smoothness of sliding) of the slider 40 is worsened due to the fray of the side end edge of the cloth 5.

Further, in Embodiment 1, it is also possible that a reinforcement sheet member such as a resin film which is not shown in the drawings is applied and attached to at least one of the top surface and the back surface of the element attaching edge portion 2, and/or to an inside of the side edge part (between the upper and lower folded portion) which is folded in a U-shape of the element attaching edge portion 2, or that it is sewn with the element member 10. The element attaching edge portion 2 can be reinforced by attaching the reinforcement sheet member to the element attaching edge portion 2 as above.

In the present invention, the configuration of the cloth 5 of the clothing item 1 is not limited particularly, and can be changed depending on use of the clothing item 1, etc.

In the conventional slide fastener, an end stop is generally provided adjacent to a front end and a rear end of the element rows in order to prevent the slider from separating from the element rows and falling. In contrast, in Embodiment 1, a cloth piece as a component part of the clothing item 1 is sewn to overlap the front end part and the rear end part of the element rows 3 instead of the end stops provided adjacent to the front end and the rear end of the element rows 3. Thereby, the cloth piece serves as the end stop, and the slider 40 can be prevented from falling from the front end and the rear end of the element rows 3.

It is also possible in the present invention that other means is used in order to prevent the slider 40 from falling. As the means to prevent the slider 40 from falling, for example, it is possible to form the end stops in a predetermined shape at a position adjacent to the front end and the rear end of the element rows 3, to form the end stop by attaching an exclusive end stop part to the element 11 disposed at the front end part and the rear end part of the element rows 3, to bond or weld a resin film to the front end part and the rear end part of the element rows 3, to fold and sew an extended part of the cloth 5 which extends from the front end part and the rear end part of the element rows 3, to sew the front end part and the rear end part of the right and left element rows 3 in the fastener width direction in a state that they are coupled, and to provide a separable rear end stop having an insert pin, a box pin and a box body instead of the end stop.

The element member 10 of Embodiment 1 has a plurality of independent elements 11 (also referred to as solo element) and a string-shaped connecting member 12 which connects the plurality of elements 11 at constant intervals. The connecting member 12 of Embodiment 1 is a member having a cross-section perpendicular to the length direction in a substantially circle shape. Particularly, it is preferable to be a member having a circular-shaped cross-section and a constant cross-sectional area of the cross-section in the length direction.

As the connecting member 12, a monofilament, a twisted thread (twisted string), or a string body (also referred to as a knitted code) formed by wrapping around a core yarn formed of a plurality of drawn multifilaments with a woven bag portion knitted by a plurality of knitted yarns can be used. As long as a plurality of elements can be attached to, the connecting member is not limited particularly. The cross-sectional shape of the connecting member can be arbitrarily changed as necessary. Further, the element member in the present invention may be formed by connecting a plurality of elements by two or more string-shaped connecting members.

The plurality of elements 11 forming the element member 10 in Embodiment 1 are lined in a line along the length direction of the element member 10 in a connected state by the connecting member 12 at regular intervals. These elements 11 are formed integrally with the connecting member 12 by injection-molding thermoplastic resin such as polyamide, polyacetal, polypropylene, polybutylene terephthalate to a single connecting member 12.

It should be noted that in the present invention, a material of the element is not limited to the synthetic resin as above, and the element can be formed with other synthetic resin or metal, for example. The element member 10 of Embodiment 1 is not limited to the one in which the elements 11 are formed by injection-molding the thermoplastic resin to the connecting member 12, and includes the one formed by fixing such as welding or bonding the elements formed in a predetermined shape by injection-molding thermoplastic resin to the connecting member 12.

Further, the element member of the present invention is not limited to the one in which injection-molded synthetic resin elements 11 are integrally formed to be connected to the connecting member 12 as in Embodiment 1. The element member of the present invention includes an element member formed by metal die casting to the string-shaped connecting member, an element member formed by cutting a linear material having a substantially Y-shaped cross-section (so called "Y-bar") to manufacture an element and attaching the element to the connecting member by pressing deformation, and an element member formed by punching a thin plate-shaped flat plate member to manufacture an element and attaching the element to the connecting member by pressing deformation.

The synthetic resin element 11 in Embodiment 1 has a body portion 11*a* fixed to the connecting member 12, a neck portion 11*b* extending from the body portion 11*a* continuously in the width direction of the element member 10 and having a constricted shape so that a dimension in the length direction becomes narrow, a coupling head portion 11*c* extending from the neck portion 11*b* further in the width direction and showing a substantially oval shape in the plan view, and a protruded piece portion 11*d* (also called as shoulder portion) protruding in a thin plate-shape from the neck portion 11*b* in the front and rear direction in the length direction. In such an element 11 of Embodiment 1, a coupling portion 11*h* engaging with the element 11 of the counterpart element member 10 to be coupled is formed of the neck portion 11*b* and the coupling head portion 11*c*.

In this case, an upper surface and a lower surface in each of the body portion 11*a*, the neck portion 11*b* and the protruded piece portion 11*d* are disposed perpendicular to the thickness direction and parallel to each other. A dimension in the thickness direction of the neck portion 11*b* (hereinafter, abbreviated to "thickness dimension") and the thickness dimension of the body portion 11*a* are set in the same size. The thickness dimension of the protruded piece portion 11*d* is set to be smaller than the thickness dimension of the body portion 11*a* and the neck portion 11*b*.

The body portion 11*a* of the element 11 has a substantially rectangular parallelepiped shape having a constant thickness dimension. In this case, the body portion 11*a* has an upper surface portion 13*a* and a lower surface portion 13*b* disposed perpendicular to the thickness direction, a front surface portion 13*c* and a rear surface portion 13*d* disposed facing toward the length direction, and a side surface part (inner side surface part) 13*e* facing toward an inner side (opposite side of the extending direction of the neck portion 11*b*) of the cloth 5 in the width direction. In Embodiment 1, the upper surface portion 13*a* and the lower surface portion 13*b* in the body portion 11*a* are disposed parallel to each other, and the front surface portion 13*c* and the rear surface portion 13*d* are disposed parallel to each other. It should be noted that in Embodiment 1, it is also possible that the front surface portion 13*c* and the rear surface portion 13*d* of the body portion 11*a* are disposed in a position relationship to be sloped each other instead of being parallel to each other.

In the body portion 11*a* of Embodiment 1, respective ridge line portions 11*e* disposed between the upper surface portion 13*a* and the front surface portion 13*c*, the rear surface portion 13*d* or the side surface part 13*e*, or between the lower surface portion 13*b* and the front surface portion 13*c*, the rear surface portion 13*d* or the side surface part 13*e*, and the ridge line portions 11*e* disposed between the front surface portion 13*c* and the side surface part 13*e* or between the rear surface portion 13*d* and the side surface part 13*e* are formed to be a smooth curved surface having a round shape so as to be chamfered when seeing a cross-section of each ridge line portion 11*e*. Thereby, at the time, and after, the element member 10 is sewn to the element attaching edge portion 2 of the cloth 5 by forming the sewn portion for fixing 15 with a zigzag stitch sewing machine as described later, the sewing thread 16 of the sewn portion for fixing 15 can be less likely to be damaged even if the sewing thread 16 of the sewn portion for fixing 15 is contacted with the body portion 11*a* of the element 11.

Further, in the side surface part 13*e* facing to an inside of the cloth 5 in the body portion 11*a*, an insertion concave portion 11*f* to which a part of the element attaching edge portion 2 of the cloth 5 is inserted is provided along the length direction of the element member 10. The insertion concave portion 11*f* is provided concavely at the side surface part 13*e* of the body portion 11*a* at a size corresponding to a thickness dimension of the element attaching edge portion 2 of the cloth 5. A front surface of the insertion concave portion 11*f* is formed in a smooth curved-surface shape with respect to the thickness dimension. The element member 10 in a state that the element attaching edge portion 2 of the cloth 5 is inserted to the insertion concave portion 11*f* provided in each element 11 is fixed to the element attaching edge portion 2 with the sewn portion for fixing 15 as above, thereby each element 11 can be fixed firmly and stably to the element attaching edge portion 2 in a predetermined aspect.

In such a body portion 11*a* of the element 11, a connecting member 12 is penetrated along the length direction, and is held in a state that the outer peripheral surface of the connecting member 12 is wrapped by the body portion 11*a* not to be exposed outside. In this case, the connecting member 12 is held at a central portion in the thickness direction of the body portion 11*a*.

A concave groove portion 11*g* is formed along the length direction at a central portion in the thickness direction of a top end part (tip end part) of the coupling head portion 11*c* in the element 11. The concave groove portion 11*g* is formed so that, when the right and left element rows 3 are coupled, the protruded piece portion 11*d* of the counterpart element 11 to be coupled can be fit in. Therefore, the maximum value of the thickness dimension of the concave groove portion 11*g* is set larger than the thickness dimension of the protruded piece portion 11*d* of the element 11. As each element 11 has the concave groove portion 11*g* of the coupling head portion 11*c* and the front and rear protruded piece portions 11*d* as above, when the right and left elements 11 are coupled, relative position displacement in the upper and lower direction can be effectively prevented.

The element member 10 of Embodiment 1 as mentioned above is lined at a position adjacent to an outside in the width direction with respect to the element attaching edge portion 2 of the cloth 5 and fixed with the sewn portion for fixing (sewing line) 15. In this case, the sewn portion for fixing 15 are formed by sewing with the zigzag stitch sewing machine, and formed to be bent in a zigzag shape with respect to the length direction with lock stitches. With the sewn portion for fixing 15, the element member 10 is fixed to the element attaching edge portion 2 in a state that the body portion 11*a* of each element 11 is contacted with the element attaching edge portion 2 of the cloth 5.

The zigzag stitch sewing machine here means a sewing machine which can sew the cloth 5 and others with lock stitches in a zigzag shape while swinging a sewing needle along a crossing direction which crosses in a feeding direction of the sewing machine. The swing of the sewing needle in the zigzag stitch sewing machine is sometimes referred to as zigzag swing. By using such a zigzag stitch sewing machine and conducting sewing by setting coordinate data in X-coordinate (a position in the feeding direction) and Y-coordinate (a position in the crossing direction) which become a needle location, for example, the sewn portion for fixing 15 formed after sewing can be bent easily to be in a zigzag shape in the crossing direction with respect to the feeding direction of the zigzag stitch sewing machine.

In Embodiment 1, the sewing thread 16 of the sewn portion for fixing 15 formed by lock stitches has an upper thread (needle thread) 16*a* running on a top surface (first surface) of the element attaching edge portion 2 and contacting a half portion on the top surface side of the connecting member 12 and a lower thread (bobbin thread) 16*b* running on the back surface (second surface) of the element attaching edge portion 2 and contacting a half portion on the back surface side of the connecting member 12. In this case, since the sewn portion for fixing 15 is formed by lock stitching, the upper thread 16*a* and the lower thread 16*b* are disposed in position relations plane-symmetrical to each other except a part where both cross.

In this case, a conventional general sewing thread is used for the upper thread 16*a* and the lower thread 16*b* of the lock stitches. Further, the upper thread 16*a* and the lower thread 16*b* in the lock stitches cross (interlace) each other at piercing positions (first piercing position 18*a* and second piercing position 18*b*, described later) in which the sewn portion for fixing 15 pierces the element attaching edge portion 2 and at a position contacting with the outer peripheral surface of the connecting member 12.

The upper thread 16*a* and the lower thread 16*b* of the sewn portion for fixing 15 cross each other at a position between the upper thread 16*a* running on the top surface of the element attaching edge portion 2 and the lower thread 16*b* running on the back surface of the element attaching edge portion 2 with respect to the thickness direction. Particularly in Embodiment 1, the upper thread 16*a* and the lower thread 16*b* cross each other at a position of a central portion in the thickness direction in the element attaching edge portion 2. Thereby, the crossed portion of the upper thread 16*a* and the lower thread 16*b* in the piercing position can be protected by the element attaching edge portion 2 as well as can be less likely to be seen from the outside. It should be noted that the crossing position of the upper thread 16*a* and the lower thread 16*b* in the thickness direction can be easily changed by controlling tension of the upper thread 16*a* and the lower thread 16*b* in the zigzag stitch sewing machine.

The sewn portion for fixing 15 in Embodiment 1 is formed by interlacing the upper thread 16*a* and the lower thread 16*b* with lock stitches using the zigzag stitch sewing machine as above. Thereby, the sewn portion for fixing 15 can pierces the element attaching edge portion 11 of the cloth 5 and holds the connecting member 12 of the element member 10 so as to wrap it. Therefore, the element member 10 is attached and fixed easily and stably to the element attaching edge portion 11 of the cloth 5 with the sewn portion for fixing 15.

In Embodiment 1, it is also possible that at the time the upper thread 16*a* and the lower thread 16*b* of the sewn portion for fixing 15 pierce the element attaching edge portion 11 of the cloth 5, the upper thread 16*a* and the lower thread 16*b* pierce and hold the connecting member 12 of the element member 10, too, thereby the element member 10 is attached to the element attaching edge portion 11 of the cloth 5.

Further, since the sewn portion for fixing 15 is formed by using a zigzag stitch sewing machine, it can be effectively prevented that the upper thread 16*a* and the lower thread 16*b* of the sewn portion for fixing 15 after sewing are disposed to overlap the element 11 so as to cross on the top surface (upper surface) and the back surface (lower surface) of the element 11. Thereby, defects such as looseness of the upper thread 16*a* and the lower thread 16*b* of the sewn portion for fixing 15, lowered smooth coupling of the element rows 3 (ease of coupling) and lowered slidability of the slider 40 due to the overlap of the upper thread 16*a* and the lower thread 16*b* of the sewn portion for fixing 15 with the element 11 can be prevented.

The sewn portion for fixing 15 of Embodiment 1 has a unit running area in which the upper thread 16*a* and the lower thread 16*b* of the lock stitches run from an outer peripheral crossing position to cross on an outer peripheral surface of a connecting member 12 to a next outer peripheral crossing position to cross on the outer peripheral surface of the next connecting member 12 with respect to one element 11, and is formed by repeating the unit running areas at every element 11 in the length direction. In this case, each unit running area forming the sewn portion for fixing 15 of Embodiment 1 has two piercing positions in which the sewn portion for fixing 15 pierces the element attaching edge portion 2. In a case that the upper thread 16*a* and the lower thread 16*b* of the sewn portion for fixing 15 also pierce the connecting member 12 as above, the unit running area of the sewn portion for fixing 15 means an area from one piercing position of the connecting member in which the upper thread 16*a* and the lower thread 16*b* pierce the connecting member 12 to a next piercing position of the connecting member with respect to one element 11.

The unit running area of Embodiment 1 will be described here in detail referring to FIG. 2. The upper thread 16*a* and the lower thread 16*b* of the sewn portion for fixing 15 in Embodiment 1 has a first running portion 17*a* disposed from the outer peripheral crossing position in which the upper thread 16*a* and the lower thread 16*b* cross on an outer peripheral surface of the connecting member 12 to a first first piercing position 18*a*, a second running portion 17*b* disposed from the first piercing position 18*a* to a next second piercing position 18*b*, and a third running portion 17*c* disposed from the second piercing position 18*b* to a next outer peripheral crossing position.

In this case, the first running portion 17*a* is formed such that the upper thread 16*a* (or the lower thread 16*b*) runs from the outer peripheral crossing position as above to a position corresponding to the side surface part 13*e* of the element 11 in the width direction along the width direction (or substantially width direction), and further runs obliquely to the width direction to the first piercing position 18*a*. In this case, a boundary between a part running along the width direction and a part running obliquely to the width direction in the first running portion 17*a* may contact the body portion 11*a* of the element 11, in some cases. The second running portion 17*b* is formed such that the upper thread 16*a* (or the lower thread 16*b*) runs along the length direction of the element member 10 between the first piercing position 18*a* and the second piercing position 18*b*. The third running portion 17*c* is formed such that the upper thread 16*a* (or the lower thread 16*b*) runs obliquely to the width direction from the second piercing position 18*b* to a position corresponding to the side surface part 13*e* of the element 11 in the width direction, and further runs to the outer peripheral crossing position along the width direction (or substantially width direction). In this case, the boundary between a part running obliquely to the width direction and the part running along the width direction of the third running portion 17*c* may contact the body portion 11*a* of the element 11, in some cases.

When the sewn portion for fixing 15 is formed such that the upper thread 16*a* and the lower thread 16*b* run as above, in a plan view viewed from the upper direction of the element member 10 and the element attaching edge portion 2 of the cloth 5 (or a bottom view viewed from the lower direction), as shown in FIG. 2, the side surface part 13*e* on an inside of the element 11 and a part of the sewn portion for fixing 15 which is formed further inside of the side surface part 13*e* of the element 11 in the cloth 5 are disposed to show an isosceles trapezoid shape.

In Embodiment 1 in particular, the sewn portion for fixing 15 is formed so that the first piercing position 18*a* and the second piercing position 18*b* which pierce the element attaching edge portion 11 of the cloth 5 are separated from the inner side surface part 13*e* of each element 11 toward an inside of the cloth 5 in the width direction (in other words, an opposite direction of a direction facing to a counterpart element 11 to be coupled). That is, a constant interval is provided between the first and second piercing positions 18*a*, 18*b* of the sewn portion for fixing 15 and the side surface part 13*e* of each element 11 with respect to the width direction of the element member 10.

In this case, a dimension (separation distance) W between the first and second piercing positions 18*a*, 18*b* of the element member 10 and a position of the side surface part 13*e* of each element 11 in the width direction is specifically set at 0.4 mm or more, and preferably at 0.8 mm or more. Further in this case, the above dimension (separation distance) W is preferably set to be larger than the thickness dimension of the cloth 5.

The first and second piercing positions 18*a*, 18*b* of the sewn portion for fixing 15 are set at positions as above, and the upper thread 16*a* and the lower thread 16*b* of the sewn portion for fixing 15 can be prevented more stably from overlapping the top surface and the back surface of the element 11. Further, an interval in the width direction between the first and second piercing positions 18*a*, 18*b* and the side end edge of the element attaching edge portion 2 can be secured in a large degree. Thereby, strength of the element attaching edge portion 11 can be secured easily and stably, and damages of the cloth 5 such that the cloth 5 is cut from the first or second piercing position 18*a*, 18*b* to a side end edge of the element attaching edge portion 2 rubbed by the upper thread 16*a* and the lower thread 16*b* can be less likely to occur.

Meanwhile, the dimension (separation distance) W between the first and second piercing positions 18*a*, 18*b* of the sewn portion for fixing 15 and the side surface part 13*e* of each element 11 is set at 30 mm or less, preferably 10 mm or less and more preferably 5 mm or less. As it is set at such a size, the element member 10 can be stably fixed to the element attaching edge portion 2 of the cloth 5 with the sewn portion for fixing 15, and the position displacement of the elements 11 can be effectively prevented.

Further in this case, a dimension (separation distance) W between the first and second piercing positions 18*a*, 18*b* of the sewn portion for fixing 15 and a position of the side surface part 13*e* of each element 11 in the width direction is preferably set larger than a dimension of a flange portion 41*d* of the slider 40 to be attached in the width direction as described later as shown in FIG. 4. In FIG. 4, a part of the slider 40 is represented by an imaginary line. That is, the first and second piercing positions 18*a*, 18*b* of the sewn portion for fixing 15 in Embodiment 1 are disposed to be an outside of a position of the flange portion 41*d* of the slider 40 to be used.

Thereby, even when the sliding operation of the slider 40 is repeated, the flange portion 41*d* of the slider 40 can be less likely to contact directly to the element attaching edge portion 2 of the cloth 5. Therefore, the element attaching edge portion 2 is less likely to be worn by the flange portion 41*d* of the slider 40, and the abrasion of the cloth 5 can be alleviated. Further, the element attaching edge portion 2 is less likely to be damaged due to the rubbing of the flange portion 41*d* of the slider 40 against the element attaching edge portion 2, and durability of the element attaching edge portion 2 can be improved.

In Embodiment 1, the first piercing position 18*a* and the second piercing position 18*b* of the sewn portion for fixing 15 are disposed in a region 6 corresponding to a forming area of the body portion 11*a* of the element 11 regarding the length direction of the element member 10, as shown in FIG. 2. Since the first piecing position 18*a* and the second piercing position 18*b* are disposed in the above region 6, the element member 10 can be firmly fixed to the element attaching edge portion 2 of the cloth 5 with the sewn portion for fixing 15, and a position of each element 11 in the length direction of the element member 10 can be less likely to be displaced with respect to the element attaching edge portion 2.

In the slide fastener-attached clothing item 1 in Embodiment 1, an auxiliary sewn portion 19 is continuously formed to fasten the upper thread 16*a* and the lower thread 16*b* of the sewn portion for fixing 15 not to be loosened in an area between the position of the side surface part 13*e* of each element 11 and the piercing positions of the sewn portion for fixing 15 (the first piercing position 18*a* and the second piercing position 18*b*) in the width direction.

Particularly, the auxiliary sewn portion 19 of Embodiment 1 is linearly formed by lock stitching which interlaces an auxiliary upper thread (needle thread) 19*a* and an auxiliary lower thread (bobbin thread) 19*b* using a sewing machine along the length direction of the element member 10. As the auxiliary sewn portion 19 is formed by lock stitching, the auxiliary sewn portion 19 can be easily and stably formed, and the upper thread 16*a* and the lower thread 16*b* of the sewn portion for fixing 15 can be stably pressed (fastened) as described later. Therefore, the auxiliary sewn portion 19 can also be referred to as a sewn portion for fastening 19.

In this case, the auxiliary upper thread 19*a* and the auxiliary lower thread 19*b* of the auxiliary sewn portion 19 cross (interlace) each other at a piercing position to which the auxiliary sewn portion 19 pierces the element attaching edge portion 2, and at a position in a central portion in the thickness direction in the element attaching edge portion 2. It should be noted that the crossing position of the auxiliary upper thread 19*a* and the auxiliary lower thread 19*b* in the thickness direction can be changed by controlling tension of the auxiliary upper thread 19*a* and the auxiliary lower thread 19*b* in the sewing machine.

The piercing position that the auxiliary sewn portion 19 of Embodiment 1 pierces the element attaching edge portion 2 is in an area in the width direction between the side surface part 13*e* of the element 11 and the piercing position of the sewn portion for fixing 15. In other words, it is disposed in an area which overlaps a part of the first and third running portions 17*a*, 17*c* running obliquely with respect to the width direction in the sewn portion for fixing 15, as mentioned above, and the auxiliary upper thread 19*a* of the auxiliary sewn portion 19 crosses the upper thread 16*a* of the sewn portion for fixing 15 and the auxiliary lower thread 19*b* of the auxiliary sewn portion 19 crosses the lower thread 16*b* of the sewn portion for fixing 15, respectively in the area.

As the auxiliary sewn portion 19 is formed as above, the upper thread 16*a* and the lower thread 16*b* of the sewn portion for fixing 15 can be pressed by the auxiliary upper thread 19*a* and the auxiliary lower thread 19*b* from above and below toward the element attaching edge portion 2 (in other words, inward in the thickness direction). Thereby, the upper thread 16*a* and the lower thread 16*b* of the sewn portion for fixing 15 can be fastened by the auxiliary sewn portion 19, and tension is applied thereto. Therefore, even when the upper thread 16*a* and the lower thread 16*b* of the sewn portion for fixing 15 loosen, the looseness can be eliminated. Further, the looseness of the upper thread 16*a* and the lower thread 16*b* in the sewn portion for fixing 15 can also be effectively prevented. Accordingly, the element member 10 can be fixed more firmly with the sewn portion for fixing 15.

Furthermore, since the auxiliary sewn portion 19 is formed to overlap the sewn portion for fixing 15, when the slider 40 is operated to slide repeatedly, the flange portion 41*d* of the slider 40 is less likely to be sliding-contacted with respect to the element attaching edge portion 2 of the cloth 5. Therefore, the element attaching edge portion 2 can be protected more stably from the flange portion 41*d* of the slider 40. Thus, the durability of the element attaching edge portion 2 can be further enhanced.

Further, the piercing position that the auxiliary sewn portion 19 of Embodiment 1 pierces the element attaching edge portion 2 is disposed, as shown in FIG. 4, in an area in the width direction between the side surface part 13*e* of the element 11 and the piercing position of the sewn portion for fixing 15, and disposed in a central position between the side surface part 13*e* of the element 11 and the piercing position of the sewn portion for fixing 15 in the width direction, or at a position between the central position and the piercing position of the sewn portion for fixing 15. Further in this case, it is preferable that the piercing position of the auxiliary sewn portion 19 is disposed at a position between the upper and lower flange portions 41*d* of the slider 40 to be attached (in other words, a position facing to the upper and lower flange portions 41*d*), or outside of a position of the upper and lower flange portions 41*d* of the slider 40.

As the piercing position of the auxiliary sewn portion 19 is set as above, when the upper thread 16*a* and the lower thread 16*b* of the sewn portion for fixing 15 are pressed by the auxiliary sewn portion 19, the sewn portion for fixing 15 can be prevented from being loosened effectively. In addition, compared to a case that the piercing position of the auxiliary sewn portion 19 is set between the element 11 and the central position as above, the elements 11 of right and left element rows 3 can be easy to be coupled and separated serially in the element guide pass of the slider 40 when the slider 40 is slid. Therefore, the slider 40 can be slid smoothly and lightly.

It should be noted that although the auxiliary sewn portion 19 of Embodiment 1 is formed by straight lock stitching along the length direction, the auxiliary sewn portion 19 can be formed by stitching other than lock stitching such as multi-thread chain stitching in the present invention, as long as the auxiliary sewn portion 19 can press the upper thread

16*a* and the lower thread 16*b* of the sewn portion for fixing 15 toward the element attaching edge portion 2.

The slider 40 to be attached to the element rows 3 in Embodiment 1 has a slider body 41 and a tab 42 provided with an attaching axis portion at one end part, as schematically shown in FIG. 1. The slider body 41 of Embodiment 1 has an upper blade 41*a*, a lower blade 41*c* disposed separately to be parallel to the upper blade 41*a*, a connecting post connecting front end parts (shoulder mouth side end parts) of the upper blade 41*a* and the lower blade 41*c*, upper and lower flange portions 41*d* disposed at right and left side edge parts of the upper blade 41*a* and the lower blade 41*c*, and a tab attaching portion 41*b* disposed on an upper surface of the upper blade 41*a*, whose detailed configuration thereof is not shown in the drawings.

In the front end part of the slider body 41, right and left shoulder mouths are formed interposing a guide post, and a rear mouth is formed at a rear end part of the slider body 41. Between the upper blade 41*a* and the lower blade 41*c*, an element guide pass communicating the right and left shoulder mouths and the rear mouth, and having a substantially Y-shape is formed. Further, between the upper and lower flange portions 41*d* of the slider body 41, an insertion gap to which the element attaching edge portion 2 of the cloth 5 is inserted is formed parallel to the upper blade 41*a* and the lower blade 41*c*. Using the slider 40 having the above mentioned structure enables to smooth coupling and separating of the right and left element members 10 directly fixed to the element attaching edge portion 2 of the cloth 5 of the clothing item 1.

Next, a manufacturing method of a slide fastener-attached clothing item 1 in Embodiment 1 having the element member 10 as mentioned above will be explained.

First, the element member 10 and the cloth 5 of the clothing item 1 are prepared. The element member 10 of Embodiment 1 is manufactured by injection-molding synthetic resin directly to one string-shaped connecting member 12, and forming a plurality of elements 11 having a predetermined shape at regular intervals, as described above.

In the meantime, a cloth for the clothing item 1 which becomes a fastener-attached member is manufactured by weaving or knitting separately from the element member 10. In this time, if waterproof property needs to be added to the cloth 5, for example, it is also possible to apply synthetic resin or put a resin film on the woven or knitted cloth. Further, the manufactured cloth is cut to be a predetermined shape corresponding to a front bodies of the clothing item 1, and the cloth 5 (cloth parts) serving as a fastener attached member for a right and left pair of the front bodies is manufactured. Further, a side edge part which is a cut end edge portion in the cut right and left cloths 5 is folded in a U-shape, thereby the element attaching edge portion 2 for attaching the element member 10 is formed on the cloths 5. In this case, the element attaching edge portions 2 formed respectively on the cloth 5 of the right and left pair of front bodies, are provided on a position disposed facing to each other when the clothing item 1 is manufactured.

Next, using the element member 10 manufactured as above and the cloths 5 (cloth parts) which are cut in a predetermined shape and in which the element attaching edge portion 2 is formed, clothes component parts for forming the clothing item 1 with the element member 10 is manufactured.

First, as the first sewing step, the element member 10 is sewn to the element attaching edge portion 2 of the cloth 5 using a zigzag stitch sewing machine as shown in FIG. 5, for example. In this case, when sewing is conducted to the element member 10 and the element attaching edge portion 2 of the cloth 5 using a zigzag stitch sewing machine in which coordinate data of needle locations are set, the sewn portion for fixing 15 as shown in FIG. 2 etc. is formed, and the element member 10 can be attached (sewn) and fixed to the element attaching edge portion 2 of the cloth 5 with the sewn portion for fixing 15.

Next, as the second sewing step, the auxiliary sewn portion 19 is formed by sewing with a single needle lock stitch sewing machine with respect to the element attaching edge portion 2 of the cloth 5 to which the element member 10 is fixed with the sewn portion for fixing 15. Thereby, the auxiliary sewn portion 19 formed of the above-mentioned linear lock stitches can be stably formed at a predetermined position of the element attaching edge portion 2 in which the sewn portion for fixing 15 is formed.

As a result, the upper thread 16*a* and the lower thread 16*b* of the sewn portion for fixing 15 can be pressed toward the element attaching edge portion 2 with the auxiliary sewn portion 19, thereby the element member 10 can be fixed to the element attaching edge portion 2 more firmly. Thus, the right and left cloth parts of the clothing item 1 having the element member 10 in which the element member 10 is fixed to the element attaching edge portion 2 with the sewn portion for fixing 15 and the auxiliary sewn portion 19, as shown in FIGS. 2 to 4 is manufactured. In Embodiment 1, in addition to the above-mentioned right and left pair of the cloth parts, other cloth parts constituting right and left sleeve portions and a back body in the clothing item 1, which are not shown in the drawings, are manufactured and prepared.

Thereafter, the clothing item 1 is assembled by combining each manufactured cloth parts by sewing each other and the like. Further, the slider 40 is slidably attached to the element rows 3 formed by fixing the element member 10 to the element attaching edge portion 2 of the cloth 5. Thereby, the slide fastener-attached clothing item 1 as shown in FIG. 1 is stably manufactured.

In the slide fastener-attached clothing item 1 of Embodiment 1 manufactured as above, a part of the cloth 5 of the clothing item 1 not only constitutes the clothing item 1, but also functions as a fastener tape in a conventional slide fastener. Therefore in the slide fastener-attached clothing item 1, the function of the slide fastener can be obtained in a shape omitting the fastener tape (in other words, a shape of the slide fastener without the fastener tape) which had been an essential constituent parts of the conventional slide fastener. Thereby, a manufacturing cost of the slide fastener-attached clothing item 1 (material cost in particular) can be decreased. Further, weight of the slide fastener-attached clothing item 1 can be reduced, and flexibility of the clothing item 1 can be improved. In the case of the clothing item 1 of Embodiment 1, in particular, flexibility of the cloth 5 in the front placket portion of the clothing item 1 in the top and back direction can be enhanced.

Further in Embodiment 1, the element member 10 can be fixed directly to the cloth 5 after a desired function such as waterproof property or water-repellent property is applied to the cloth 5. Therefore, it becomes possible to easily manufacture a high quality slide fastener-attached clothing item 1 having waterproof property or water-repellent property.

It should be noted that in manufacturing the slide fastener-attached clothing item 1 of the above-mentioned Embodiment 1, the element member 10 is fixed by sewing after the cloth parts for the front body are cut in a predetermined shape. In the present invention, however, it is also possible to manufacture the cloth parts having the element member 10 by fixing the element member 10 at a predetermined position by sewing with respect to the cloth 5 before cutting, and thereafter cutting the cloth 5 with the element member 10 in a predetermined shape.

Figure 6:
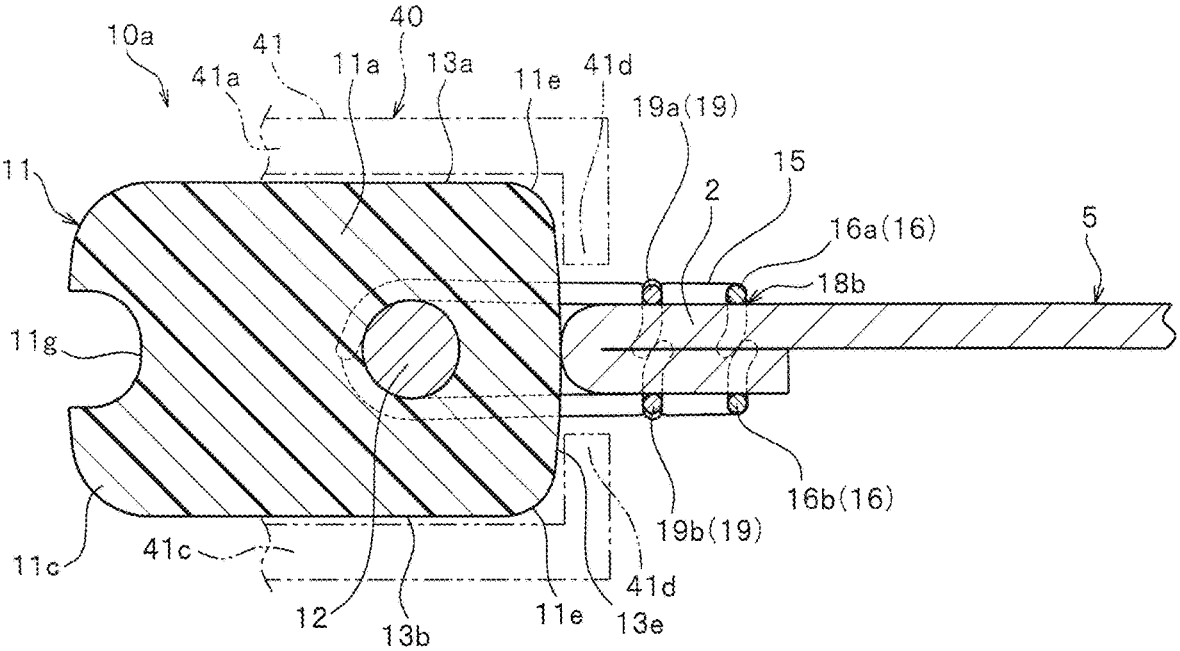
FIG. 6 is a cross-sectional view illustrating a main part of a slide fastener-attached product according to a modification example of Embodiment 1.

In the element member 10 of Embodiment 1, in order to firmly fix the elements 11 to the element attaching edge portion 2 of the cloth 5 in a predetermined posture, an insertion concave portion 11*f* to which a part of the element attaching edge portion 2 of the cloth 5 can be inserted is provided on the side surface part 13*e* of each element 11, as described above. In the present invention, however, it is also possible to manufacture an element member 10*a* by forming a plurality of elements 11 in which the insertion concave portion 11*f* as in Embodiment 1 is not provided on the side surface part 13*e* are integrally formed on the connecting member 12, as shown in the element member 10*a* according to modification example of Embodiment 1 in FIG. 6.

The element member 10*a* and the element attaching edge portion 2 of the cloth 5 of the modification example are formed as same as the element member 10 and the element attaching edge portion 2 of the cloth 5 in the above-mentioned Embodiment 1 except that the insertion concave portion 11*f* is not provided in each element 11. For example, the first piercing position 18*a* and the second piercing position 18*b* of the sewn portion for fixing 15 in the modification example are disposed to be apart from each element 11 regarding the width direction of the element member 10*a*, and particularly, disposed to be an outside of a position of the flange portion 41*d* of the slider 40. Further, the piercing position that the auxiliary sewn portion 19 pierces the element attaching edge portion 2 in the modification example is disposed at a position between the upper and lower flange portions 41*d* of the slider 40, or a position outside of the upper and lower flange portions 41*d* of the slider 40.

Also in the slide fastener-attached clothing item in which the element member 10*a* is fixed to the element attaching edge portion 2 of the cloth 5 according to the modification example of Embodiment 1, the element member 10 is firmly fixed to the cloth 5. Therefore, a substantially same effect as that in the slide fastener-attached clothing item 1 as the above-mentioned Embodiment 1 can be obtained.

Further, in the above-mentioned Embodiment 1, each unit running area of the sewn portion for fixing 15 has two piercing positions which are a first piercing position 18*a* and a second piercing position 18*b* piercing the element attaching edge portion 2 of the cloth 5. In the present invention, however, it is also possible that the number of piercing positions which pierces the element attaching edge portion 2 in each unit running area of the sewn portion for fixing 15 may be one, three or more.

Embodiment 2

Figure 7:
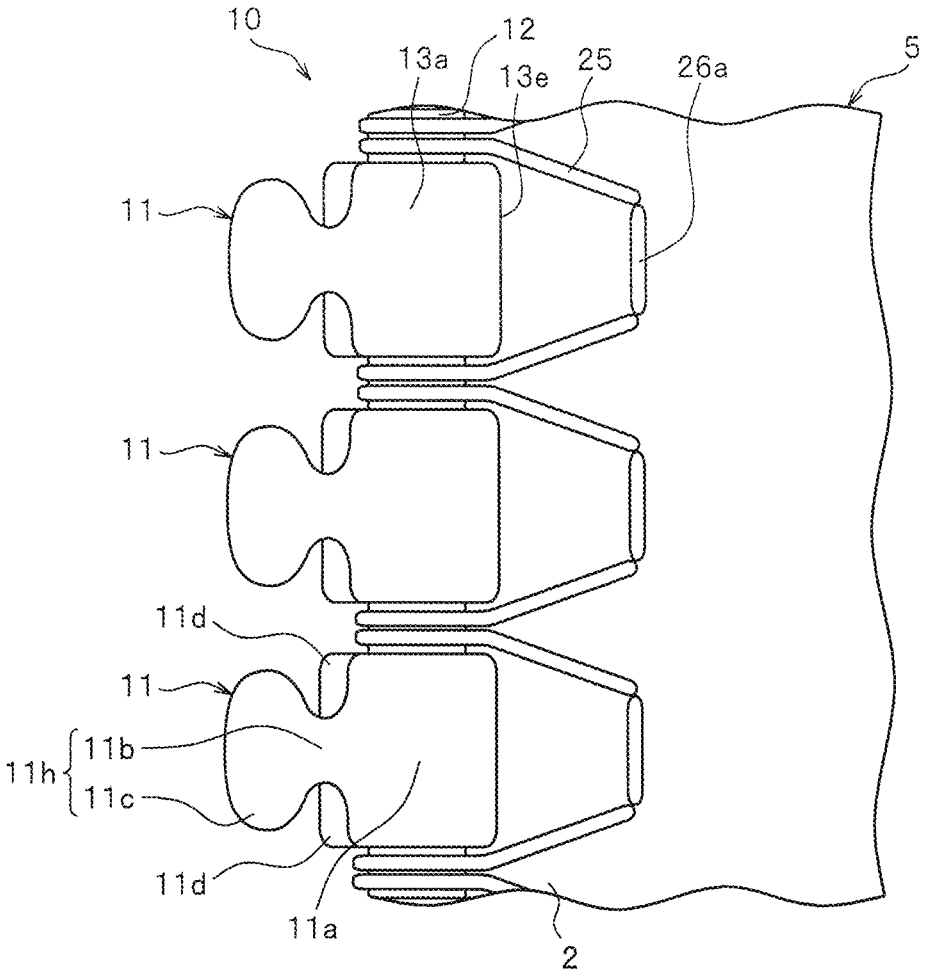
FIG. 7 is a plan view illustrating a main part of a slide fastener-attached product according to Embodiment 2 of the present invention.
Figure 8:
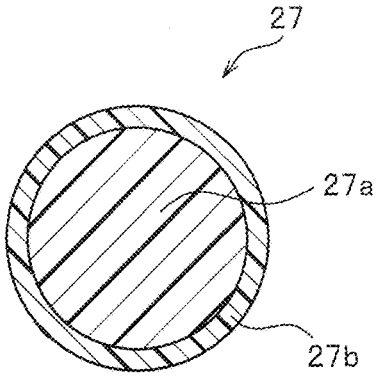
FIG. 8 is a cross-sectional view illustrating a thread (welded thread) of a sewn portion for fixing which fixes the element member to the fastener attaching portion of a product in Embodiment 2.

FIG. 7 is a plan view illustrating a main part of slide fastener-attached clothing item 1 according to Embodiment 2. FIG. 8 is a cross-sectional view illustrating a thread forming a sewn portion for fixing 15 which fixes the element member 10.

It should be noted that in Embodiment 2 and Embodiment 3, as described later, explanations of the parts and the members having the substantially same feature as Embodiment 1 as mentioned above are represented with the same reference signs, and not explained.

In the slide fastener-attached clothing item according to Embodiment 2, element members 10 are respectively sewn to the element attaching edge portions 2 of the cloth 5 to form right and left element rows 3. In this case, the element attaching edge portion 2 of the cloth 5 and the element member 10 themselves are formed as same as the element attaching edge portion 2 of the cloth 5 and the element member 10 in the above-mentioned Embodiment 1. However, a structure fixing the element member 10 to the element attaching edge portion 2 of cloth 5 is different from the case of Embodiment 1 as above.

That is, in Embodiment 1, the element member 10 is firmly fixed to the element attaching edge portion 2 of the cloth 5 with the sewn portion for fixing 15 formed with a zigzag stitch sewing machine and with the auxiliary sewn portion 19 formed with a lock stitch sewing machine without loosening in the upper thread 16*a* and the lower thread 16*b* of the sewn portion for fixing 15.

In contrast, in the slide fastener-attached clothing item of Embodiment 2, the auxiliary sewn portion 19 of Embodiment 1 which is formed with the lock stitch sewing machine is not formed, and the element member 10 is fixed to the element attaching edge portion 2 of the cloth 5 only with the sewn portion for fixing 25 formed with the zigzag stitch sewing machine.

Stitches and unit running areas of the sewn portion for fixing 25 in Embodiment 2 are formed as same as a case of the sewn portion for fixing 15 in the above mentioned Embodiment 1. However, a welded thread 27 (also referred to as fusible thread) having a structure of a cross-section shown in FIG. 8 is used as the upper thread (needle thread) 26*a* and the lower thread (bobbin thread) forming the sewn portion for fixing 25 in Embodiment 2 instead of an ordinary sewing thread as in Embodiment 1.

The welded thread 27 shown in FIG. 8 has a core-sheath structure in which a core portion 27*a* disposed in a central portion in the cross-section and a sheath portion 27*b* disposed to surround the core portion 27*a*. The core portion 27*a* of the welded thread 27 is formed of a fiber material which is not melt even when heated to more than a predetermined temperature, or a fiber material having a thermal contraction property which contracts by heating. The sheath portion 27*b* of the welded thread 27 is formed of a fiber material having a thermal welding property which is melt by heating to more than a predetermined temperature.

In this case, complex ratio of the core portion 27*a* and the sheath portion 27*b* in the cross-section of the welded thread 27 (in other words, a proportion of the cross-sectional area) is not particularly limited, and can be set arbitrarily.

In Embodiment 2, the above-mentioned welded thread 27 is used for the upper thread 26*a* and the lower thread of the lock stitches and sewn with a zigzag stitch sewing machine. Thereby, the sewn portion for fixing 25 is formed, and the element member 10 can be fixed to the element attaching edge portion 2 of the cloth 5 with the sewn portion for fixing 25.

Further, after the sewn portion for fixing 25 is formed, a heating treatment at a predetermined temperature is conducted with respect to the sewn portion for fixing 25 (i.e. a cloth parts in which the element member 10 is fixed to the element attaching edge portion with the sewn portion for fixing 25). Thereby, the sheath portion 27*b* of the welded thread 27 used as the upper thread 26*a* and the lower thread is melt and cooled thereafter, and the core portion 27*a* of the welded thread 27 and the element attaching edge portion 2 of the cloth 5 are fused, thereby the both can be firmly fixed.

In a case that the core portion 27*a* of the welded thread 27 is formed of a fiber material having a thermal contraction property, the core portion 27*a* of the welded thread 27 can be contracted by the above heating treatment along the length direction of the thread. Therefore, even when the upper thread 26*a* and the lower thread of the sewn portion for fixing 25 are loosened at the time of sewing by a sewing machine, the looseness can be eliminated by contracting the upper thread 26*a* and the lower thread by heating treatment. Further, the looseness of the upper thread 26*a* and the lower thread of the sewn portion for fixing 25 after the heating treatment can be effectively prevented.

Accordingly in Embodiment 2, the welded thread 27 having the core-sheath structure is used for the upper thread 26*a* and the lower thread forming the sewn portion for fixing 25, and the heating treatment is conducted to the sewn portion for fixing 25 after sewn with the zigzag stitch sewing machine, thereby the element member 10 can be firmly fixed to the cloth 5 with the sewn portion for fixing 25 by the fusion of the welded thread 27, even when the auxiliary sewn portion 19 as in the above mentioned Embodiment 1 so as to overlap the sewn portion for fixing 25 is not formed.

It should be noted that in Embodiment 2, it is also possible that after the sewn portion for fixing 25 is formed using the welded thread 27 and the element member 10 is fixed to the element attaching edge portion 2 of the cloth 5, the auxiliary sewn portion 19 of the above-mentioned Embodiment 1 is formed to overlap the sewn portion for fixing 25.

In the slide fastener-attached clothing item of Embodiment 2, the element member 10 is firmly fixed to the element attaching edge portion 2 of the cloth 5. Therefore, also in the slide fastener-attached clothing item in Embodiment 2, the same effect as the slide fastener-attached clothing item 1 in Embodiment 1 as mentioned above can be obtained.

It should be noted that in Embodiment 2, instead of the above-mentioned welded thread 27, an ordinary sewing thread can be used for the upper thread (needle thread) 26*a* and the lower thread (bobbin thread) forming the sewn portion for fixing 25, and the upper thread 26*a* and the lower thread of the sewn portion for fixing 25 can be firmly fixed to the element attaching edge portion 2 of the cloth 5 by bonding with an adhesive. The element member 10 can be fixed more firmly to the cloth 5 with the sewn portion for fixing 25 in this way, too.

Embodiment 3

Figure 9:
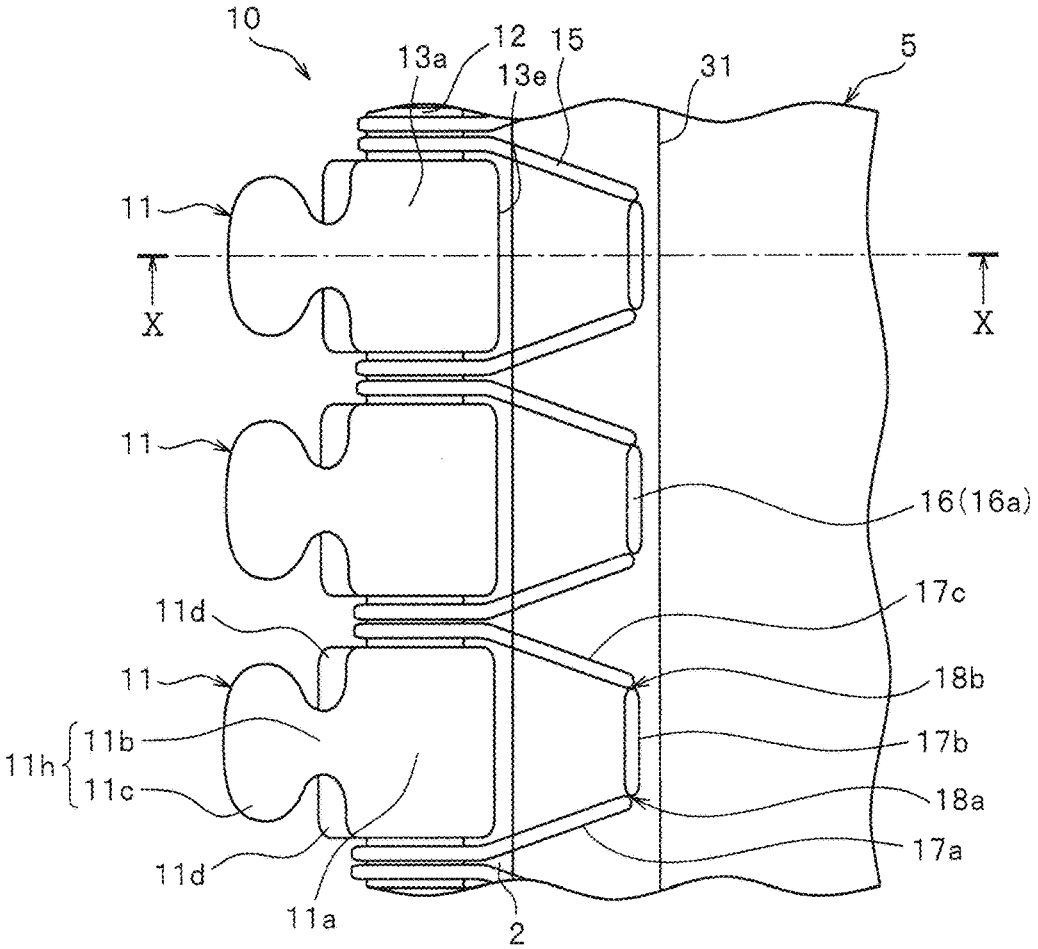
FIG. 9 is a plan view illustrating a main part of a slide fastener-attached product according to Embodiment 3 of the present invention.
Figure 10:
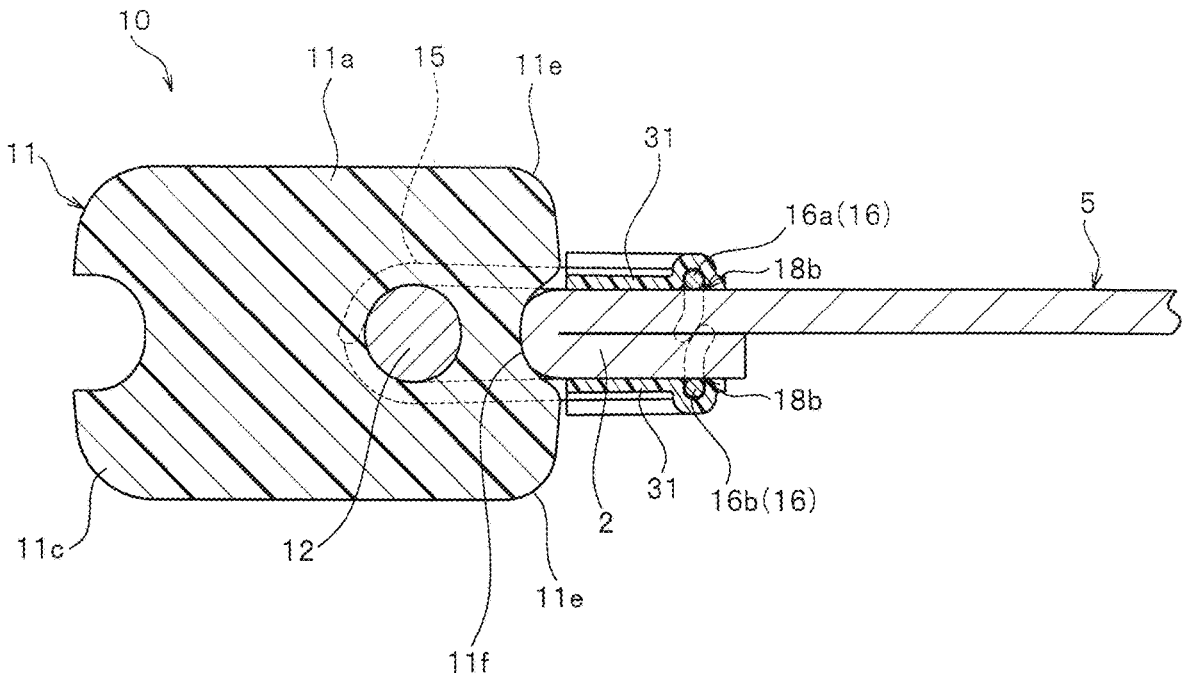
FIG. 10 is a cross-sectional view along the X-X line shown in FIG. 9.

FIG. 9 is a plan view illustrating a main part of a slide fastener-attached clothing item according to Embodiment 3. FIG. 10 is a cross-sectional view along the X-X line in FIG. 9.

In the slide fastener-attached clothing item according to Embodiment 3, the element attaching edge portion 2 of the cloth 5 and the element member 10 themselves are formed as same as the element attaching edge portion 2 of the cloth 5 and the element member 10 in Embodiment 1 as above, but the structure for fixing the element member 10 to the element attaching edge portion 2 of the cloth 5 is different from the case of Embodiment 1 as above.

In the slide fastener-attached clothing item of Embodiment 3, although the auxiliary sewn portion 19 of Embodiment 1 formed with the lock stitch sewing machine is not formed, the element member 10 is fixed to the element attaching edge portion 2 of the cloth 5 with the sewn portion for fixing 15 formed with the zigzag stitch sewing machine, and a transparent film member (tape member) 31 for fixing the sewn portion for fixing 15 to the element attaching edge portion 2 of the cloth 5 is applied to the element attaching edge portion 2 along the tape length direction. The film member 31 can be also called as the film member for fixing the thread 31 to fix the sewn thread 16 of the sewn portion for fixing 15.

In this case, the stitches and the unit running areas of the sewn portion for fixing 15 in Embodiment 3 are formed as same as those of the sewn portion for fixing 15 in the above-mentioned Embodiment 1. As the upper thread (needle thread) 16*a* and the lower thread (bobbin thread) forming the sewn portion for fixing 15 of Embodiment 3, an ordinary sewing thread is used same as Embodiment 1. In Embodiment 3, it is also possible to use the welded thread 27 having the core-sheath structure as in the above-mentioned Embodiment 2 as the upper thread 16*a* and the lower thread 16*b* forming the sewn portion for fixing 15.

The film member 31 of Embodiment 3 is formed such that adhesive or gluing agent is applied to one film surface of the film member 31. The film member 31 is applied on a top surface and a back surface of the element attaching edge portion 2 so as to cover a part of the sewn portion for fixing 15 including the first piercing position 18*a* and the second piercing position 18*b* of the sewn portion for fixing 15 after the sewn portion for fixing 15 is formed by sewing with a zigzag stitch sewing machine.

Particularly in this case, the film member 31 on the top surface side and the film member 31 on the back surface side are applied to the element member 10 in the tape length direction not to overlap the elements 11, thereby, it covers a part of the sewn portion for fixing 15 and a part of the element attaching edge portion 2 of the sewn portion for fixing 15. Therefore, a part of the upper thread 16*a* and a part of the lower thread 16*b* of the sewn portion for fixing 15 are covered with the film member 31, and can be fixed firmly to the top surface and the back surface, respectively, of the element attaching edge portion 2 of the cloth 5. In Embodiment 3, it is also possible that the film member 31 is applied on one surface only of the top surface or the back surface of the element attaching edge portion 2.

As mentioned above, in Embodiment 3, the film member 31 for fixing a part of the sewn portion for fixing 15 to the element attaching edge portion 2 is applied on the top surface and the back surface of the element attaching edge portion 2. Thereby, the upper thread 16*a* and the lower thread 16*b* of the sewn portion for fixing 15 are firmly fixed to the element attaching edge portion 2 to prevent looseness occurred in the upper thread 16*a* and the lower thread 16*b*.

Accordingly, in Embodiment 3, even when the auxiliary sewn portion 19 is not formed on the sewn portion for fixing 15 as mentioned in Embodiment 1, fixing of the element member 10 with respect to the cloth 5 with the sewn portion for fixing 15 can be enhanced by fixing the sewn portion for fixing 15 to the element attaching edge portion 2 with the film members 31 on the top surface side and the back surface side. Therefore, a substantially same effect as that of the slide fastener-attached clothing item 1 of Embodiment 1 can be obtained in the slide fastener-attached clothing item of Embodiment 3, too.

In Embodiment 3, it is also possible that instead of the film member 31 being applied as mentioned above, an adhesive is applied or coated on a region on which the film member 31 is applied, thereby the upper thread 16*a* and the lower thread 16*b* of the sewn portion for fixing 15 is adhered to the element attaching edge portion 2 and firmly fixed.

In the above-mentioned Embodiments 1 to 3, the sewn portion for fixing 15, 25 formed with a zigzag stitch sewing machine is formed by repeating a unit running area having a first running portion 17*a* and a third running portion 17*c* which has a sloped part in which the upper thread 16*a*, 26*a* and the lower thread 16*b* run obliquely with respect to the width direction, and the second running portion 17*b* in which the upper thread 16*a* and the lower thread 16*b* run between the first piercing position 18*a* and the second piercing position 18*b* along the length direction. Particularly in this case, the sewn portion for fixing 15, 25 is formed so that the side surface part 13*e* of the element 11 and a part of the sewn portion for fixing 15, 25 which is formed on an inside of the side surface part 13*e* of the element 11 in the cloth 5 show an isosceles trapezoidal-shape.

However, the shape of the unit running area of the sewn portion for fixing is not limited thereto, and the sewn portion for fixing can be formed in another shape using the zigzag stitch sewing machine, as long as the sewn portion for fixing pierces the element attaching edge portion 11 of the cloth 5 at a position apart from the element 11 to be inside of the cloth, and the sewn portion for fixing supports the connecting member 12 of the element member 10 so as to wrap it.

Figure 11:
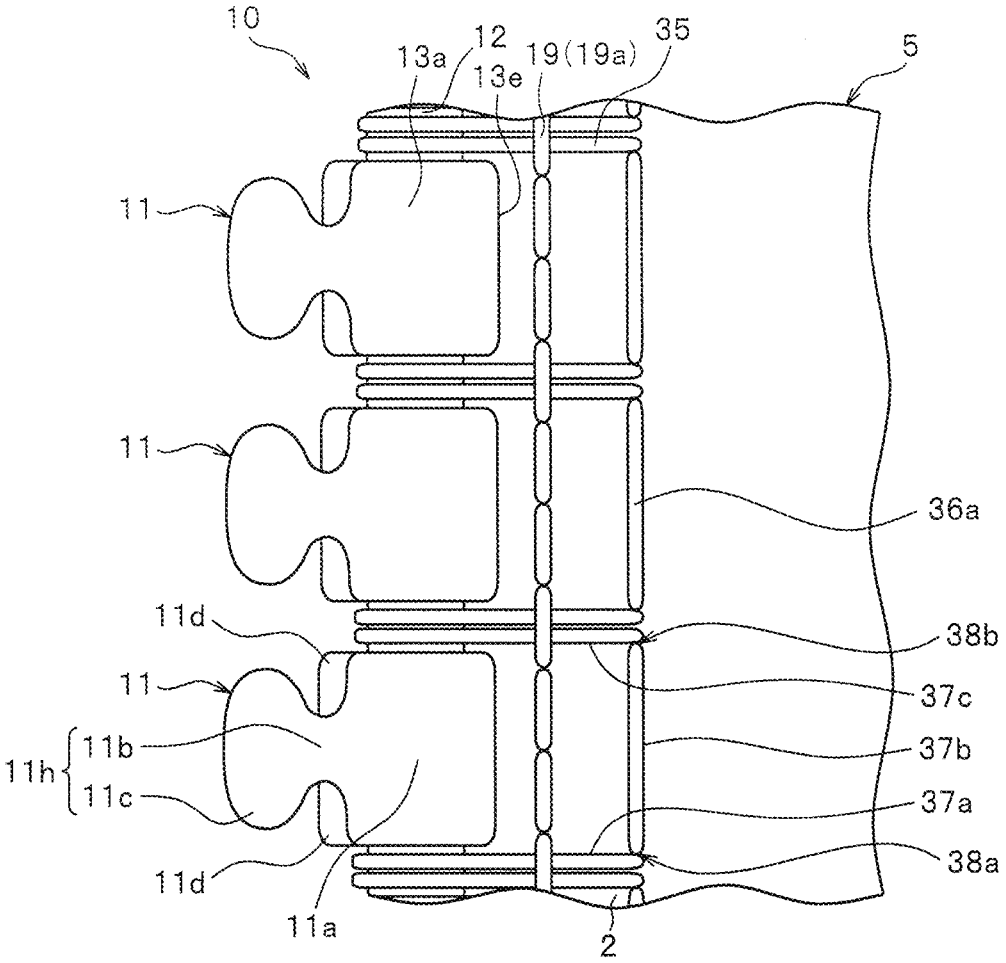
FIG. 11 is a plan view illustrating a main part of a slide fastener-attached product according to another modification example of Embodiment 1.
Figure 12:
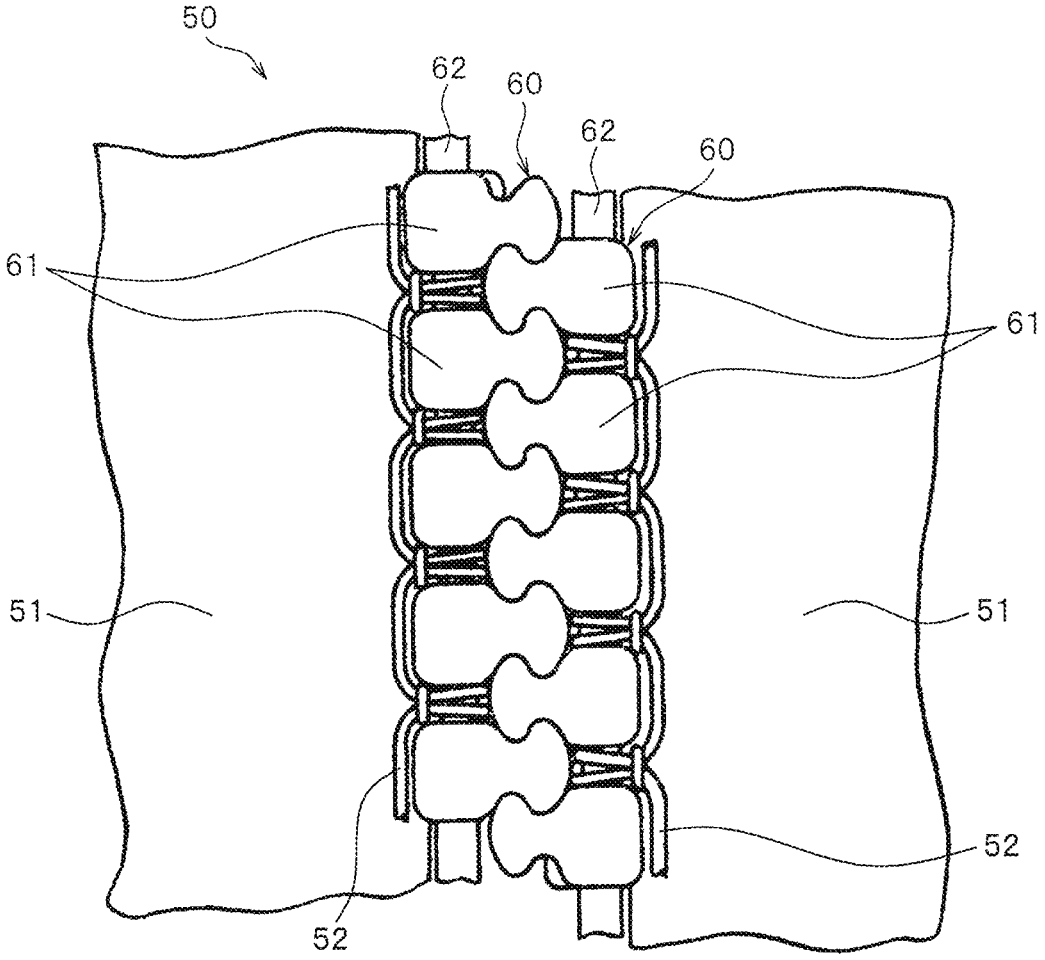
FIG. 12 is a plan view illustrating a main part of a conventional slide fastener in which an element member is sewn to a fastener tape.

As shown in the sewn portion for fixing 35 according to a modification example in FIG. 11, for example, the unit running area of the sewn portion for fixing 35 formed with the zigzag stitch sewing machine may have a first running portion 37*a* in which the upper thread 36*a* and the lower thread run linearly from an outer peripheral crossing position in which the upper thread 36*a* and the lower thread cross on the outer peripheral surface of the connecting member 12 to the first first piercing position 38*a* along the width direction, a second running portion 37*b* in which the upper thread 36*a* and the lower thread run linearly from the first piercing position 38*a* to a next second piercing position 38*b* along the length direction, and a third running portion 37*c* in which the upper thread 36*a* and the lower thread run linearly from the second piercing position 38*b* to the next outer peripheral crossing position along the width direction.

In a case that the sewn portion for fixing 35 is formed as shown in FIG. 11, the sewn portion for fixing 35 pierces the element attaching edge portion 11 of the cloth 5 and can support the connecting member 12 of the element member 10 so as to wrap it, thereby the element member 10 can be firmly and stably fixed to the element attaching edge portion 11 of the cloth 5. Further, it can be prevented more stably that the upper thread 36*a* and the lower thread of the sewn portion for fixing 35 after sewing are disposed to overlap the top surface and the back surface of the element 11. In addition, since the sewn portion for fixing 35 is formed along the length direction and the width direction, appearance and design property of the slide fastener-attached clothing item can be enhanced.

In the present invention, it is also possible that the piercing position in which the sewn portion for fixing pierces the element attaching edge portion is separated in a larger degree than the case of Embodiment 1 from the side surface part 13*e* of each element 11 toward an inside of the cloth. In this case, in each unit running area of the sewn portion for fixing, the sewn portion for fixing can be formed in a zigzag shape by decreasing the piercing positions in which the sewn portion for fixing pierces the element attaching edge portion 2 to one instead of two as shown in FIGS. 2 and 11.

Further, in the above-mentioned Embodiments 1 to 3, strength of the element attaching edge portion 2 can be enhanced by forming the element attaching edge portion 2 by folding the side edge part of the cloth 5 in a U-shape. When the cut end edge (side end edge) of the cloth 5 is frayed, the fray can be hidden on the back surface side of the element attaching edge portion 2 not to be shown.

In the present invention, however, the element attaching edge portion 2 may be formed in a state that the side edge part of the cloth 5 is drawn straight in the width direction without being folded in a U-shape. Further, when the element attaching edge portion is formed such that the side edge part of the cloth 5 is drawn straight, the strength of the element attaching edge portion which is formed straight can be enhanced stably by impregnating reinforcement agent to the side edge part of the cloth 5, or applying a reinforcement film member made of synthetic resin at the side edge part of the cloth 5 so as to wrap the side edge part.

In this case, the reinforcement agent to impregnate the cloth 5 is a curable adhesive, and the reinforcement agent such as single curable adhesive, two-pack curable adhesive, instant adhesive, hot melt adhesive, emulsion adhesive, or light curing adhesive which cures by ultraviolet ray or electron beam can be used. The reinforcement film member to be applied on the cloth 5 is a film-type member which can enhance the strength of the cloth 5 by applying. It is preferable to use a film member having low elasticity or no elasticity as the reinforcement film member.

In a case that the element attaching edge portion is reinforced by impregnation of the reinforcement agent or the application of the reinforcement film member, durability of the element attaching edge portion can be enhanced because when the upper thread 16*a* and the lower thread 16*b* of the sewn portion for fixing 15 pierce the element attaching edge portion, for example, the element attaching edge portion can be less likely to be cut by the upper thread 16*a* and the lower thread 16*b*.

Further, since the element member 10 is firmly fixed to the straight element attaching edge portion, the position and the posture of each element 11 fixed to the element attaching edge portion can be stabilized. In addition, the thread can be less likely to be frayed at the side end edge of the element attaching edge portion by impregnating the reinforcement agent or attaching the reinforcement film member to the element attaching edge portion.

REFERENCE SIGNS

1: slide fastener-attached clothing item (clothes)
2: element attaching edge portion
3: element row
5: cloth (fastener attached member)
6: region corresponding to a forming area of a body portion of an element
10, 10*a*: element member
11: element
11*a*: body portion
11*b*: neck portion
11*c*: coupling head portion
11*d*: protruded piece portion
11*e*: ridge line portion
11*f*: insertion concave portion
11*g*: concave groove portion
11*h*: coupling portion
12: connecting member
13*a*: upper surface portion
13*b*: lower surface portion
13*c*: front surface portion
13*d*: rear surface portion
13*e*: side surface part (inner side surface part)
15: sewn portion for fixing (sewing line)
16: sewing thread
16*a*: upper thread (needle thread)
16*b*: lower thread (bobbin thread)
17*a*: first running portion
17*b*: second running portion
17*c*: third running portion
18*a*: first piercing position

18*b*: second piercing position
19: auxiliary sewn portion (sewn portion for fastening)
19*a*: auxiliary upper thread (needle thread)
19*b*: auxiliary lower thread (bobbin thread)
25 sewn portion for fixing
26*a*: upper thread (needle thread)
27: welded thread
27*a*: core portion
27*b*: sheath portion
31: film member (tape member)
35: sewn portion for fixing
36*a*: upper thread
37*a*: first running portion
37*b*: second running portion
37*c*: third running portion
38*a*: first piercing position
38*b*: second piercing position
40: slider
41: slider body
41*a*: upper blade
41*b*: tab attaching portion
41*c*: lower blade
41*c*: flange portion
42: tab
W: dimension (separation distance) between the first and second piercing positions of the sewn portion for fixing and the element in a width direction

The invention claimed is:

1. A slide fastener-attached product comprising:
a pair of element members, wherein each element member includes a plurality of independent elements attached to one connecting member at regular intervals;
a slider in which an element guide pass is formed between an upper blade and a lower blade; and
a fastener attached member in which a pair of element attaching edge portions are provided at positions facing to each other,
wherein:
a width direction of the element member is orthogonal to a length direction of the element member along the connecting member and is parallel to at least one of a top surface and a back surface of each of the element attaching edge portions,
each of the element members is disposed along a respective one of the element attaching edge portions at a position outside of the element attaching edge portion in the width direction of the element member and directly fixed to the element attaching edge portion with a sewn portion for fixing,
each of the sewn portions for fixing pierces the respective element attaching edge portion, and a thread forming the sewn portion for fixing holds the connecting member, and
each of the sewn portions for fixing pierces the respective element attaching edge portion at a position apart from the elements of the respective element member and inside with respect to the elements in the width direction of the element member.

2. The slide fastener-attached product according to claim 1 wherein:
the thread forming the sewn portion for fixing holds the connecting member to wrap the connecting member while contacting with an outer peripheral surface of the connecting member.

3. The slide fastener-attached product according to claim 1 wherein:
the sewn portion for fixing is formed by lock stitching to be bent in a zigzag shape with respect to a length direction of the element member.

4. The slide fastener-attached product according to claim 1 wherein:
each element of the element member has a body portion fixed to the connecting member and a coupling portion extending from the body portion in the width direction of the element member and engaging with the element of a counterpart element member to be coupled, and a position that the sewn portion for fixing pierces the fastener attached member is disposed within a region corresponding to a forming area of the body portion of each element regarding a length direction of the element member.

5. The slide fastener-attached product according to claim 1 wherein:
each element of the element member has a body portion fixed to the connecting member and one coupling portion engaging with the element of a counterpart element member to be coupled,
each coupling portion has one neck portion extending from the body portion in the width direction of the element member and one coupling head portion further extending from the neck portion in the width direction, the body portion has an upper surface portion and a lower surface portion disposed perpendicular to a thickness direction, a front surface portion and a rear surface portion disposed facing toward the length direction and an inner side surface portion disposed on an opposite side of the neck portion in the width direction of the body portion,
the neck portion has an upper surface portion and a lower surface portion disposed perpendicular to the thickness direction,
the body portion and the neck portion are formed by a solid part where a space is not provided between the upper surface portions and the lower surface portions, and
the element member is fixed such that the inner side surface portion of the body portion disposed on an opposite side of the neck portion in the width direction is contacted with the element attaching edge portion.

6. The slide fastener-attached product according to claim 5 wherein:
an insertion concave portion to which a part of the element attaching edge portion is inserted is disposed on the inner side surface portion of the body portion of the element along a length direction of the element member.

7. The slide fastener-attached product according to claim 1 wherein:
an auxiliary sewn portion which presses a thread forming the sewn portion for fixing toward the element attaching edge portion is formed to overlap the sewn portion for fixing.

8. The slide fastener-attached product according to claim 7 wherein:
the auxiliary sewn portion is formed by linear lock stitching.

9. The slide fastener-attached product according to claim 1 wherein:
a thread forming the sewn portion for fixing is fixed to the element attaching edge portion by bonding or welding, or with a synthetic resin film member for fixing the thread applied on the element attaching edge portion.

10. The slide fastener-attached product according to claim 1 wherein:

the element attaching edge portion of the fastener attached member is formed by folding a side edge part of the fastener attached member in the width direction of the element member.

11. The slide fastener-attached product according to claim 1 wherein:

the element attaching edge portion of the fastener attached member is impregnated with a stiffener, or a synthetic resin reinforcement film member is applied on the element attaching edge portion of the fastener attached member.

12. A slide fastener-attached product comprising:

a pair of element members, wherein each element member includes a plurality of independent elements attached to one connecting member at regular intervals;

a slider in which an element guide pass is formed between an upper blade and a lower blade; and a fastener attached member in which a pair of element attaching edge portions are provided at positions facing to each other, wherein:

a width direction of the element member is orthogonal to a length direction of the element member along the connecting member and is parallel to at least one of a top surface and a back surface of each of the element attaching edge portions, each of the element members is disposed along a respective one of the element attaching edge portions at a position outside of the element attaching edge portion in the width direction of the element member and directly fixed to the element attaching edge portion with a sewn portion for fixing by lock stitching, each of the sewn portions for fixing is formed to be bent in a zigzag shape with respect to a length direction of the respective element member, each element of the element member has a body portion fixed to the connecting member and a coupling portion engaging with the element of a counterpart element member to be coupled, the coupling portion has a neck portion extending from the body portion in the width direction of the element member and a coupling head portion further extending from the neck portion in the width direction, and the element member is fixed such that a side surface part of the body portion disposed on an opposite side of the neck portion in the width direction is contacted with the element attaching edge portion.

13. The slide fastener-attached product according to claim 12 wherein:

the sewn portion for fixing pierces the element attaching edge portion, and an upper thread and a lower thread forming the sewn portion for fixing holds the connecting member.

14. The slide fastener-attached product according to claim 12 wherein:

a position that the sewn portion for fixing pierces the fastener attached member is apart from the element of the element member to be inside of the element attaching edge portion in a width direction of the element member.

15. The slide fastener-attached product according to claim 12 wherein:

each element of the element member has one body portion fixed to the connecting member and one coupling portion engaging with the element of a counterpart element member to be coupled, each coupling portion has one neck portion extending from the body portion in the width direction of the element member and one coupling head portion further extending from the neck portion in the width direction, the body portion has an upper surface portion and a lower surface portion disposed perpendicular to a thickness direction, a front surface portion and a rear surface portion disposed facing toward the length direction and an inner side surface portion disposed on an opposite side of the neck portion in the width direction of the body portion, the neck portion has an upper surface portion and a lower surface portion disposed perpendicular to the thickness direction, the body portion and the neck portion are formed by a solid part where a space is not provided between the upper surface portions and the lower surface portions, and the element member is fixed such that the inner side surface portion of the body portion disposed on an opposite side of the neck portion in the width direction is contacted with the element attaching edge portion.

16. The slide fastener-attached product according to claim 12 wherein:

an insertion concave portion to which a part of the element attaching edge portion is inserted is disposed on the side surface part in the body portion of the element along the length direction of the element member.

17. The slide fastener-attached product according to claim 12 wherein:

an auxiliary sewn portion which presses a thread forming the sewn portion for fixing toward the element attaching edge portion is formed to overlap the sewn portion for fixing.

18. The slide fastener-attached product according to claim 17 wherein:

the auxiliary sewn portion is formed by linear lock stitching.

19. The slide fastener-attached product according to claim 12 wherein:

the element attaching edge portion of the fastener attached member is formed by folding a side edge part of the fastener attached member in the width direction of the element member.

* * * * *